US006231458B1

(12) United States Patent
Cameron et al.

(10) Patent No.: US 6,231,458 B1
(45) **Date of Patent: *May 15, 2001**

(54) GOLF CLUB HEAD WITH AN INSERT ON THE STRIKING SURFACE

(75) Inventors: Don T. Cameron, Carlsbad; August L. Slivnik, Vista, both of CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/220,083

(22) Filed: Dec. 23, 1998

Related U.S. Application Data

(63) Continuation-in-part of application No. 08/711,337, filed on Sep. 6, 1996, now Pat. No. 5,944,619.

(51) Int. Cl.[7] ..... A63B 53/04
(52) U.S. Cl. ..... 473/332; 473/342
(58) Field of Search ..... 473/332, 342; 273/78

(56) References Cited

U.S. PATENT DOCUMENTS

| | | |
|---|---|---|
| Re. 19,178 | 5/1934 | Spiker . |
| D. 234,608 | 3/1975 | Raymont et al. . |
| D. 271,317 | 11/1983 | Bretl . |
| D. 294,617 | 3/1988 | Perkins . |
| D. 350,582 | 9/1994 | Miansian et al. . |
| D. 351,443 | 10/1994 | Caugh et al. . |
| D. 356,131 | 3/1995 | Trimble . |
| D. 373,161 | 8/1996 | Schmidt et al. . |
| D. 385,609 | 10/1997 | Cameron . |
| D. 385,935 | 11/1997 | Cameron . |
| D. 389,207 | 1/1998 | Cameron . |
| D. 397,752 | 9/1998 | Cameron . |
| 572,436 | 12/1896 | Mills . |
| 819,900 | 5/1906 | Martin . |
| 873,423 | 12/1907 | Govan . |
| 922,444 | 5/1909 | Youds . |
| 1,046,343 | 12/1912 | Smith . |
| 1,094,599 | 4/1914 | Samson . |
| 1,253,700 | 1/1918 | Mclaughlin . |
| 1,359,220 | 11/1920 | Beamer . |
| 1,383,654 | 7/1921 | Mattern . |
| 1,562,956 | 11/1925 | Guerne . |
| 1,617,090 | 2/1927 | Worthington . |
| 1,840,451 | 1/1932 | Jansky . |

(List continued on next page.)

FOREIGN PATENT DOCUMENTS

| | | |
|---|---|---|
| 266320 | 10/1994 | (AU) . |
| 18134 | 7/1903 | (GB) . |
| 854747 | 11/1960 | (GB) . |
| 6-091021A | 4/1994 | (JP) . |

OTHER PUBLICATIONS

Golf Digest; Jul. 1973, Advertisement for "The Solid Ones".
Golf Digest; Jan. 1980, Advertisement for "80 Honeycomb li"; col. 3,4$^{th}$ Club Set.
Golf Equipment Universal Catalogue; 1995, "Grass Hunter Golf Clubs", p. 448.
Pending utility patent application No. 09/001,812 filed Dec. 31, 1997, entitled: "Golf Club Head with a Strike Face Having a First Insert within a Second Inster".

*Primary Examiner*—Mark S. Graham
(74) *Attorney, Agent, or Firm*—Pennie & Edmonds LLP

(57) ABSTRACT

A golf club head has a strike face and an opposite back face portion. The strike face defines a recess having a bottom surface and a side wall surface extending between the bottom surface and the strike face. An insert is disposed within the recess. The insert has a peripheral edge spaced from the side wall surface to define a peripheral groove. A vibration dampening material is disposed within the groove.

11 Claims, 26 Drawing Sheets

U.S. PATENT DOCUMENTS

| | | |
|---|---|---|
| 1,854,548 | 4/1932 | Hunt . |
| 1,968,626 | 7/1934 | Young . |
| 1,968,627 | 7/1934 | Young . |
| 2,034,936 | 3/1936 | Barnhart . |
| 2,056,335 | 10/1936 | Wettlaufer . |
| 2,429,351 | 10/1947 | Fetterolf . |
| 2,463,798 | 3/1949 | Pailsey . |
| 2,592,013 | 4/1952 | Curley . |
| 2,846,228 | 8/1958 | Reach . |
| 3,134,596 | 5/1964 | Boznos . |
| 3,172,667 | 3/1965 | Baker et al. . |
| 3,211,455 | 10/1965 | Hyden . |
| 3,218,072 | 11/1965 | Burr . |
| 3,220,733 | 11/1965 | Saleeby . |
| 3,233,905 | 2/1966 | Flom . |
| 3,333,854 | 8/1967 | White . |
| 3,547,445 | 12/1970 | Hardesty . |
| 3,695,618 | 10/1972 | Woolley et al. . |
| 3,817,522 | 6/1974 | Simmons . |
| 3,819,180 | 6/1974 | Murphy . |
| 3,863,932 | 2/1975 | Lezatte . |
| 3,975,023 | 8/1976 | Inamori . |
| 3,989,248 | 11/1976 | Campau . |
| 4,121,832 | 10/1978 | Ebbing . |
| 4,156,526 | 5/1979 | Huggins et al. . |
| 4,193,601 | 3/1980 | Reid, Jr. et al. . |
| 4,194,739 | 3/1980 | Thompson . |
| 4,195,842 | 4/1980 | Coleman . |
| 4,199,144 | 4/1980 | Skelly . |
| 4,213,613 | 7/1980 | Nygren . |
| 4,325,553 | 4/1982 | Taylor . |
| 4,422,638 | 12/1983 | Tucker . |
| 4,540,178 | 9/1985 | Johnson et al. . |
| 4,573,685 | 3/1986 | Young, IV et al. . |
| 4,618,149 | 10/1986 | Maxel . |
| 4,679,792 | 7/1987 | Straza et al. . |
| 4,681,322 | 7/1987 | Straza et al. . |
| 4,697,814 | 10/1987 | Yamada . |
| 4,730,830 | 3/1988 | Tilley . |
| 4,749,197 | 6/1988 | Orlowski . |
| 4,792,140 | 12/1988 | Yamaguchi et al. . |
| 4,804,188 | 2/1989 | Mckee et al. . |
| 4,811,950 | 3/1989 | Kobayashi . |
| 4,812,187 | 3/1989 | Honma . |
| 4,881,739 | 11/1989 | Garcia . |
| 4,883,275 | 11/1989 | Boone . |
| 4,884,808 | 12/1989 | Retzer . |
| 4,928,965 | 5/1990 | Yamaguchi et al. . |
| 4,930,781 | 6/1990 | Allen . |
| 4,934,703 | 6/1990 | Delaney . |
| 4,941,666 | 7/1990 | Suganuma . |
| 5,004,242 | 4/1991 | Iwanaga et al. . |
| 5,016,883 | 5/1991 | Kobayashi . |
| 5,060,951 | 10/1991 | Allen . |
| 5,064,197 | 11/1991 | Eddy . |
| 5,078,398 | 1/1992 | Reed et al. . |
| 5,079,397 | 1/1992 | Aizawa . |
| 5,082,278 | 1/1992 | Hsien . |
| 5,083,778 | 1/1992 | Douglass . |
| 5,141,231 | 8/1992 | Cox . |
| 5,143,571 | 9/1992 | Lacoste et al. . |
| 5,154,425 | 10/1992 | Niskanen et al. . |
| 5,198,062 | 3/1993 | Chen . |
| 5,219,408 | 6/1993 | Sun . |
| 5,221,087 | 6/1993 | Fenton et al. . |
| 5,271,622 | 12/1993 | Rogerson . |
| 5,290,036 | 3/1994 | Fenton et al. . |
| 5,299,807 | 4/1994 | Hutin . |
| 5,301,941 | 4/1994 | Allen . |
| 5,303,922 | 4/1994 | Lo . |
| 5,332,214 | 7/1994 | Tucker, Sr. . |
| 5,333,871 | 8/1994 | Wishon . |
| 5,342,052 | 8/1994 | Costa . |
| 5,346,213 | 9/1994 | Yamada . |
| 5,348,302 | 9/1994 | Sasamoto et al. . |
| 5,354,059 | 10/1994 | Stuff . |
| 5,362,055 | 11/1994 | Rennie . |
| 5,385,348 | 1/1995 | Wargo . |
| 5,398,929 | 3/1995 | Kitiachi . |
| 5,403,007 | 4/1995 | Chen . |
| 5,405,137 | 4/1995 | Vincent et al. . |
| 5,407,202 | 4/1995 | Igarashi . |
| 5,425,535 | 6/1995 | Gee . |
| 5,429,354 | 7/1995 | Long et al. . |
| 5,431,396 | 7/1995 | Shieh . |
| 5,433,440 | 7/1995 | Lin . |
| 5,437,447 | 8/1995 | Rigutto . |
| 5,447,311 | 9/1995 | Viollaz et al. . |
| 5,458,332 | 10/1995 | Fisher . |
| 5,472,201 | 12/1995 | Aizawa et al. . |
| 5,497,993 | 3/1996 | Shan . |
| 5,509,660 | 4/1996 | Elmer . |
| 5,529,543 | 6/1996 | Beaumont, Sr. . |
| 5,575,472 | 11/1996 | Magerman et al. . |
| 5,601,501 | 2/1997 | Kobayashi . |
| 5,603,667 | 2/1997 | Ezaki et al. . |
| 5,674,132 | 10/1997 | Fisher . |
| 5,676,605 | 10/1997 | Kobayashi . |
| 5,690,562 | 11/1997 | Sturm . |
| 5,707,302 | 1/1998 | Leon et al. . |
| 5,713,800 | 2/1998 | Su . |
| 5,735,755 | 4/1998 | Kobayashi . |
| 5,766,093 | 6/1998 | Rohrer . |
| 5,766,094 | 6/1998 | Mahaffey et al. . |
| 5,772,527 | 6/1998 | Liu . |

GOLF CLUB HEAD WITH AN INSERT ON THE STRIKING SURFACE

This application is a continuation-in-part of application Ser. No. 08/711,337, filed Sep. 6, 1996, U.S. Pat. No. 5,944,619 the disclosure of which is incorporated by reference in its entirety.

TECHNICAL FIELD

The present invention relates to golf clubs and, more particularly, to a golf club that has an insert on the strike surface of the club.

BACKGROUND OF THE INVENTION

Golf clubs have long been developed to improve the "touch and feel" of the club, most particularly with, but not limited to, the clubs used on and around the green. One approach to improve the touch and feel of a club is to modify either the grip, the shaft, or the strike face of the golf club. For example, modifications to the club head could include an insert that is placed on the club strike surface to affect the impact of the club with the golf ball and to improve the feedback to the golfer after impact.

SUMMARY OF THE INVENTION

An object of the present invention is to provide a golf club with an improved "touch and feel" on and around the green.

Another object of the present invention is to provide a golf club with an insert on the strike face that affects the rebound of the golf ball at impact with the strike face.

Another object of the present invention is to provide a golf club that dampens vibrations and improves the feedback to the golfer at impact of the golf club with the golf ball.

According to the present invention, a golf club includes a strike surface and an opposite back face portion. The strike face includes a recess with a bottom surface and a side wall surface. The club head further includes an insert which is disposed in the recess. The insert has a peripheral outer edge that is spaced from the side wall surface to define a peripheral groove. A vibration dampening material is disposed within the groove to vary the feel of the club.

According to one embodiment, the insert further includes a first portion and a second portion, where the first portion extends radially outwardly from the second portion. When the insert is within the recess, the first portion contacts a portion of the side walls and the second portion includes the peripheral edge.

In another embodiment, the club head further includes a back face portion opposite the strike face and a plurality of apertures that extend into the back face portion of the club head toward the insert. At least one of the apertures is filled with a vibration dampening material.

In yet another embodiment, the insert is modified so that the vibration dampening material in the groove communicates and is continuous with the vibration dampening material in the apertures.

According to a separate embodiment of the invention, a golf club includes a strike surface and an opposite back face portion. A metal insert is located on and is positioned flush with the strike surface. A plurality of apertures extend into the back face portion of the club head toward the insert. At least one of the apertures is filled with a vibration dampening means, where the insert and the vibration dampening means are of different materials.

The configuration of the insert and club head vary the amount of vibration dampening material within the club to vary the feel of the club.

DETAILED DESCRIPTION OF THE INVENTION

Figure 1:
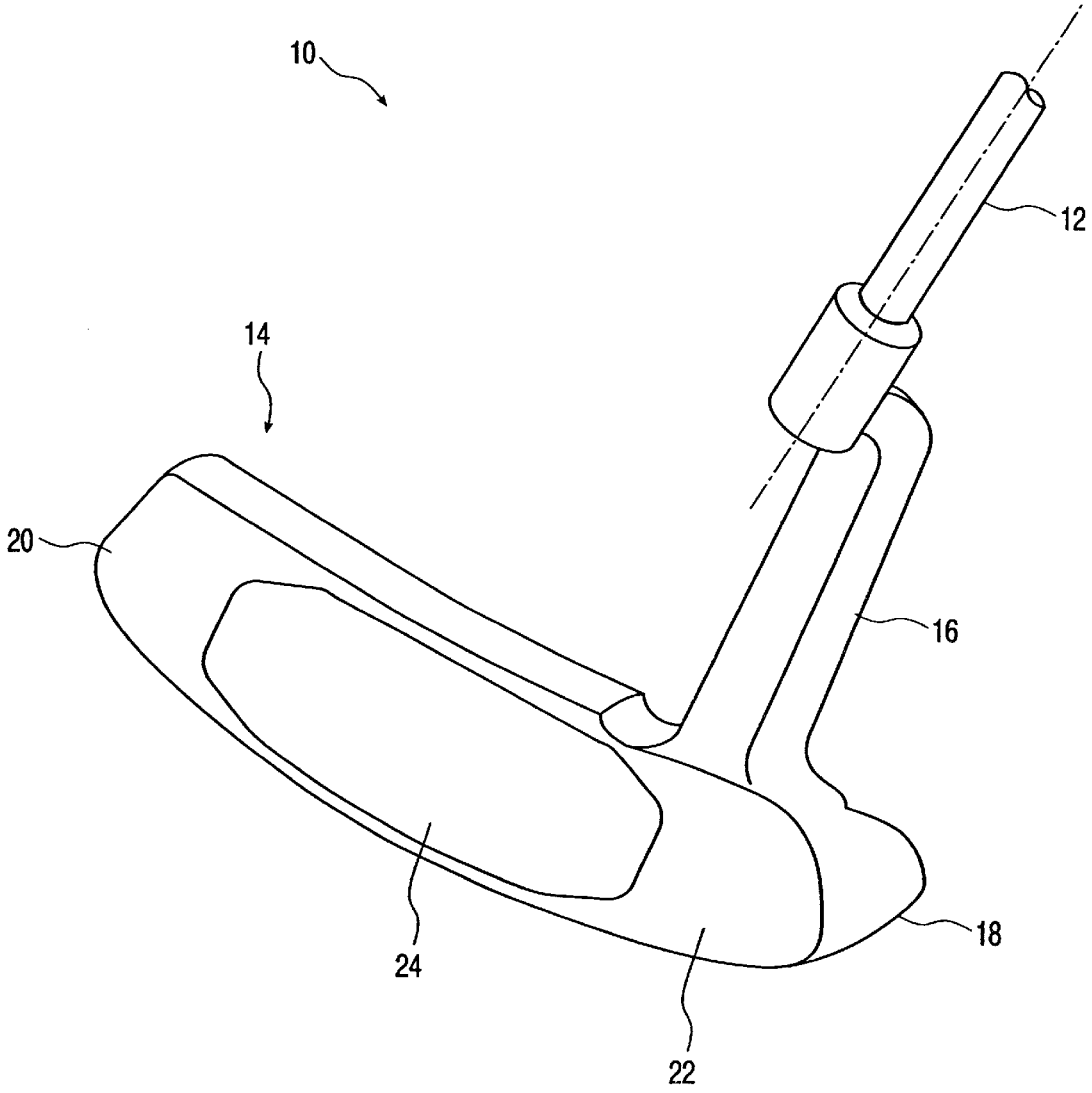
FIG. 1 is a front perspective view of a golf club head of the present invention showing an insert located on a strike face.
Figure 2:
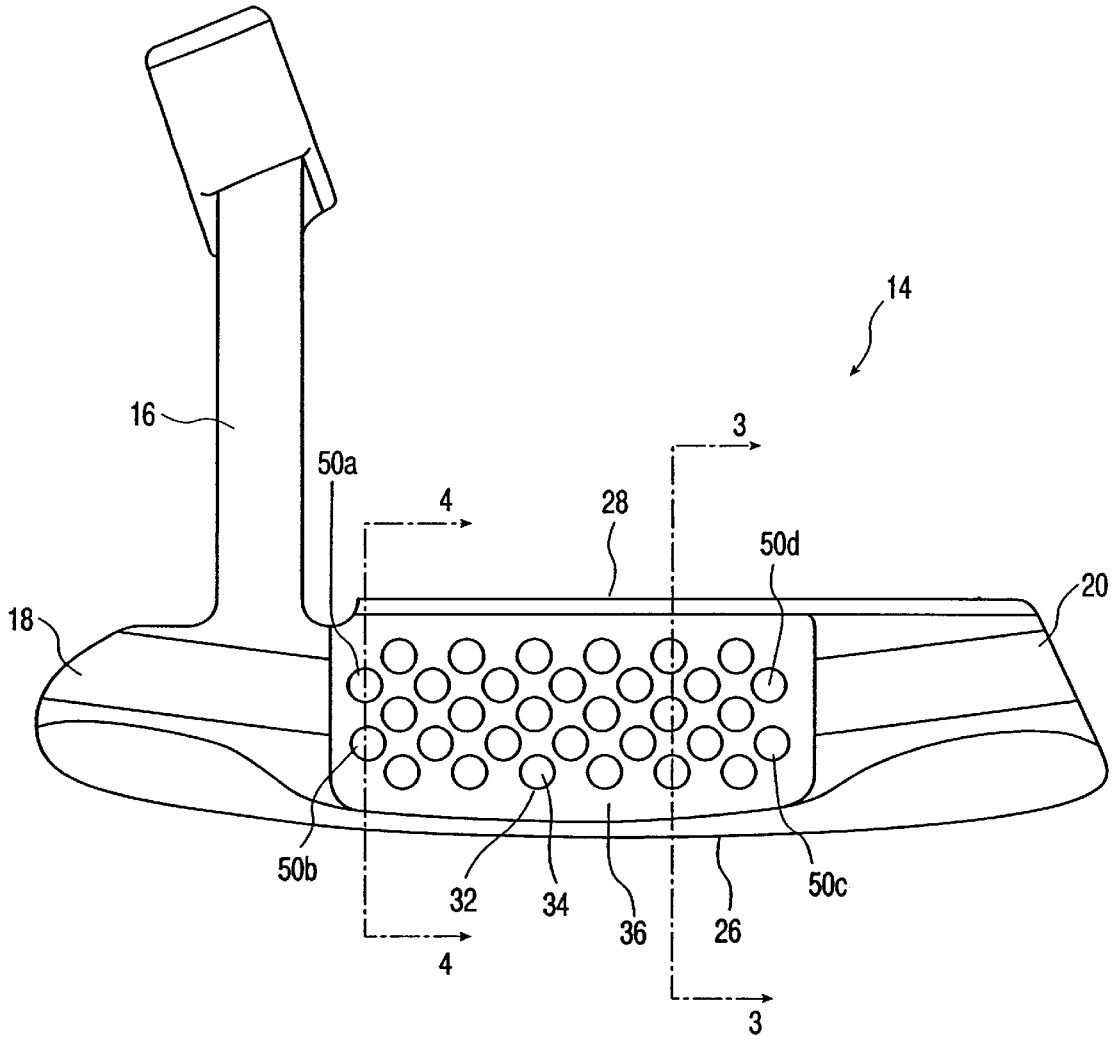
FIG. 2 is a rear view of the golf club head of the present invention showing a plurality of apertures spaced apart on a back face of a club head.

According to the present invention and referring to FIGS. 1 and 2, a golf club 10 has a shaft 12 (only partially shown) attached to a club head 14. A putter-type club head is shown in FIG. 1, however, as explained below, an iron-type club head may also be utilized with the present invention.

The club head 14 has a hosel 16 that accepts the shaft 12 with a heel 18 at the hosel end of the club head 14 and a toe 20 opposite of the heel 18. The club head 14 also has a sole portion 26 and an opposite top portion 28. Extending between the heel 14 and the toe 20 is a strike face 22, which is the surface that contacts the golf ball (not shown) upon impact between the golf club 10 and the ball. The strike face 22 includes a "sweet spot," or the center of gravity in the toe to heel direction, which is covered with an insert 24. The insert 24 is made of a material that is different than the rest of the club head. In the preferred embodiment, the insert is made of a tellurium copper alloy, which is a relatively soft alloy that improves the touch and feel of the club. In the preferred embodiment, the tellurium copper alloy includes a minimum of 99.4% copper, a maximum of 0.004–0.012 ppm of phosphorus and a maximum of 0.4–0.7 ppm of tellurium, and has a hardness of approximately 80 HB.

As shown in FIG. 2, the club head 14 has an essentially flat back face portion 36 that extends partially between the heel 18 and the toe 20 and partially between the top portion 28 and the sole portion 26. The back face portion 36 has a plurality of apertures 32 that are preferably evenly spaced apart in relation to each other, that follow the contour of the back face portion 36 and that are essentially perpendicular to the strike face 22.

Figure 3:
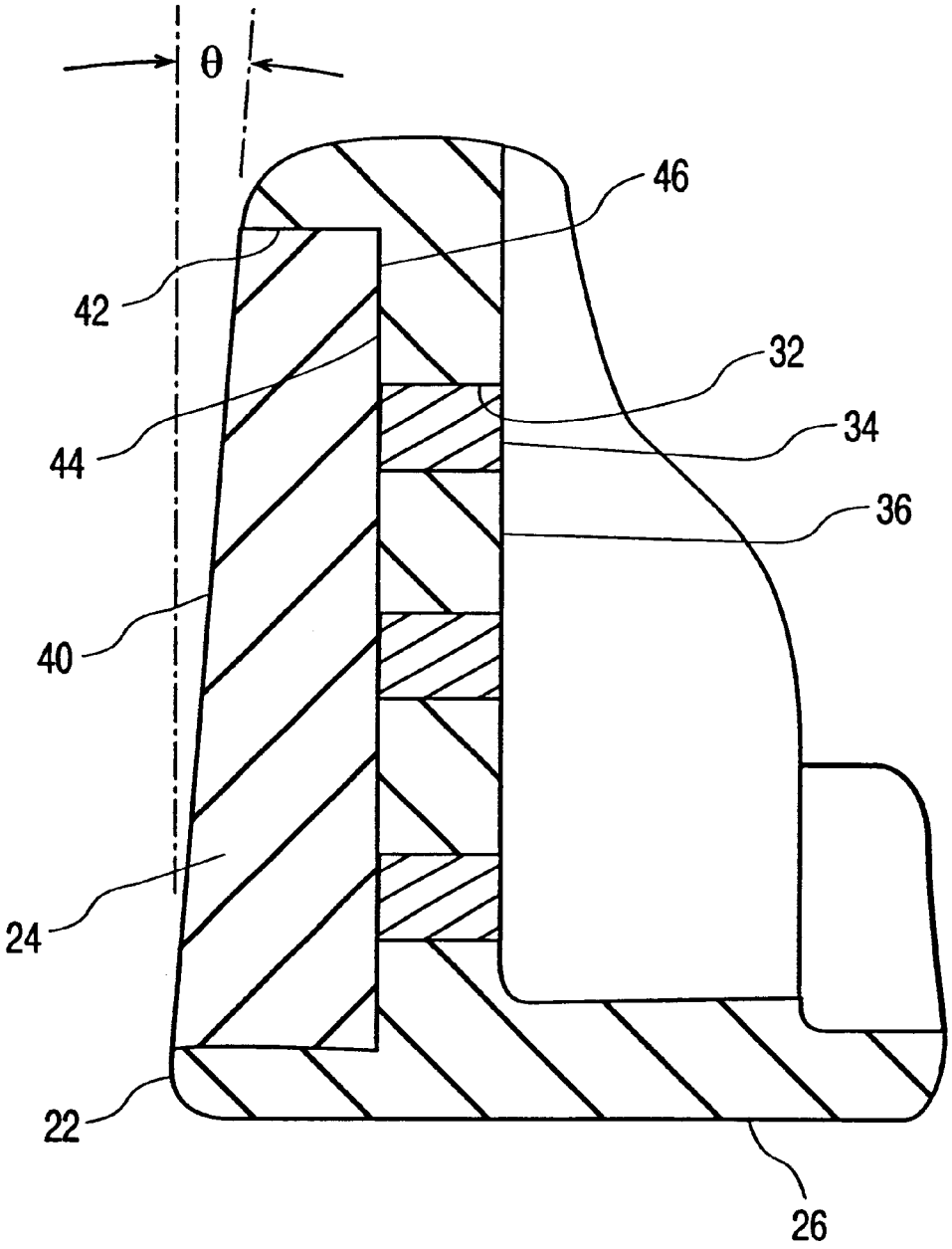
FIG. 3 is a cross-sectional view taken from line 3—3 of FIG. 2 showing the apertures filled with an elastomeric material.

As shown in FIG. 3, the apertures 32 extend from the back face 36 toward the insert 24. Preferably more than five apertures are used, more preferably there are greater than 20 apertures, and most preferably there are 32 apertures. A vibration dampening means, such as an elastomeric material 34 that is deformable is located in each aperture 32. In the preferred embodiment, which will be described in detail below, the elastomeric material is a silicone material, Stock No. GE281, available from General Electric Company in Waterford, N.Y.

As shown in FIG. 3, the insert 24 is press fit into a complementary strike face recess 42. The interference fit between the insert 24 and the strike face recess 42 is approximately 0.002–0.003 inches. The insert 24 has a back face 46, which is in contact with and adjacent to a recess bottom surface 44. The contact between the two surfaces creates a metal-to-metal contact between the insert 40 and the recess bottom surface 44. The size of the apertures 32 and the volume of the elastomeric material 34 located in the apertures combine to reduce the amount of metal-to-metal contact between the insert 40 and the recess bottom surface 44. Therefore, the "touch and the feel" of the putter may be altered by varying the amount of metal-to-metal contact and by proportionately varying amount of elastomeric material located in the back face 36.

The insert 24 has a strike face 40 that is essentially axially aligned with the club head strike face 22. The strike faces 22 and 40 have a loft angle θ, which for a standard lofted putter the loft angle is approximately 4 degrees.

Figure 4:
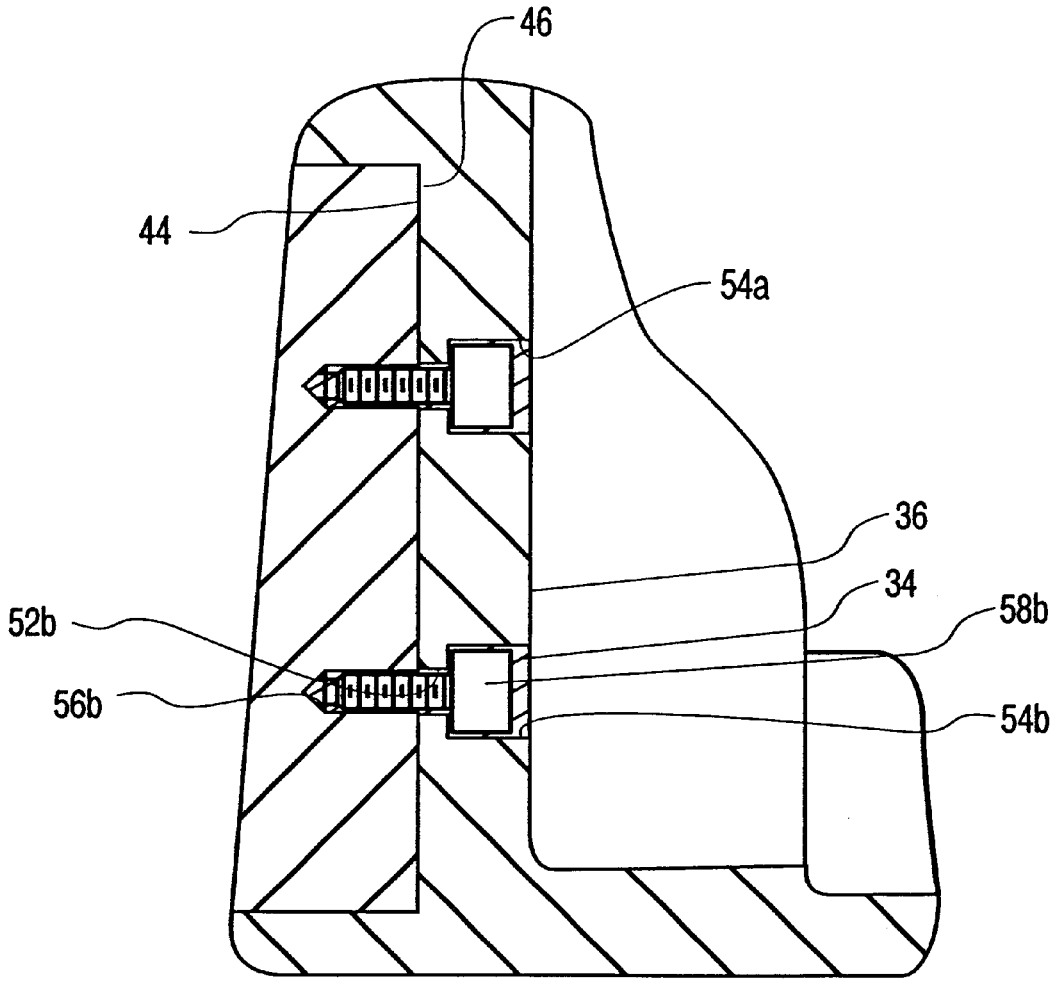
FIG. 4 is a cross-sectional view taken from line 4—4 of FIG. 2 showing fasteners extending through the back face and into the insert.
Figure 5:
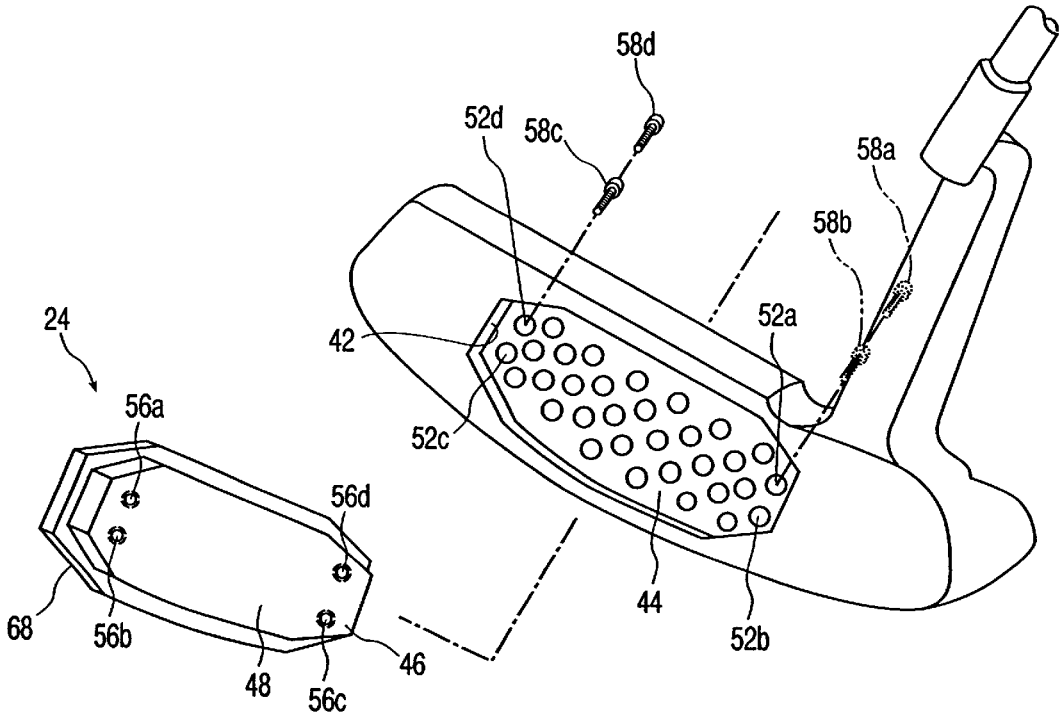
FIG. 5 is an exploded front perspective view of the golf club of the present invention showing the club head before assembly.

Referring now to FIGS. 2, 4 and 5, four of the outermost apertures 50*a*, 50*b*, 50*c* and 50*d* accept a fastening means. In the embodiments described herein, the additional fastening means is four (4) allen head fasteners with a "0" primary size and a Fine UNF thread rating of 80 by 0.250 inches long, which is represented by numerals 58*a*, 58*b*, 58*c* and 58*d*. The outermost apertures 50*a*, 50*b*, 50*c* and 50*d* follow the outer contour of the back face 36 and each have a complementary clearance hole 52*a*, 52*b*, 52*c* and 52*d* and a complementary counterbore 54*a*, 54*b*, 54*c* and 54*d* (only counterbores 54*a* and 54*b* are shown in FIG. 4).

Figure 6:
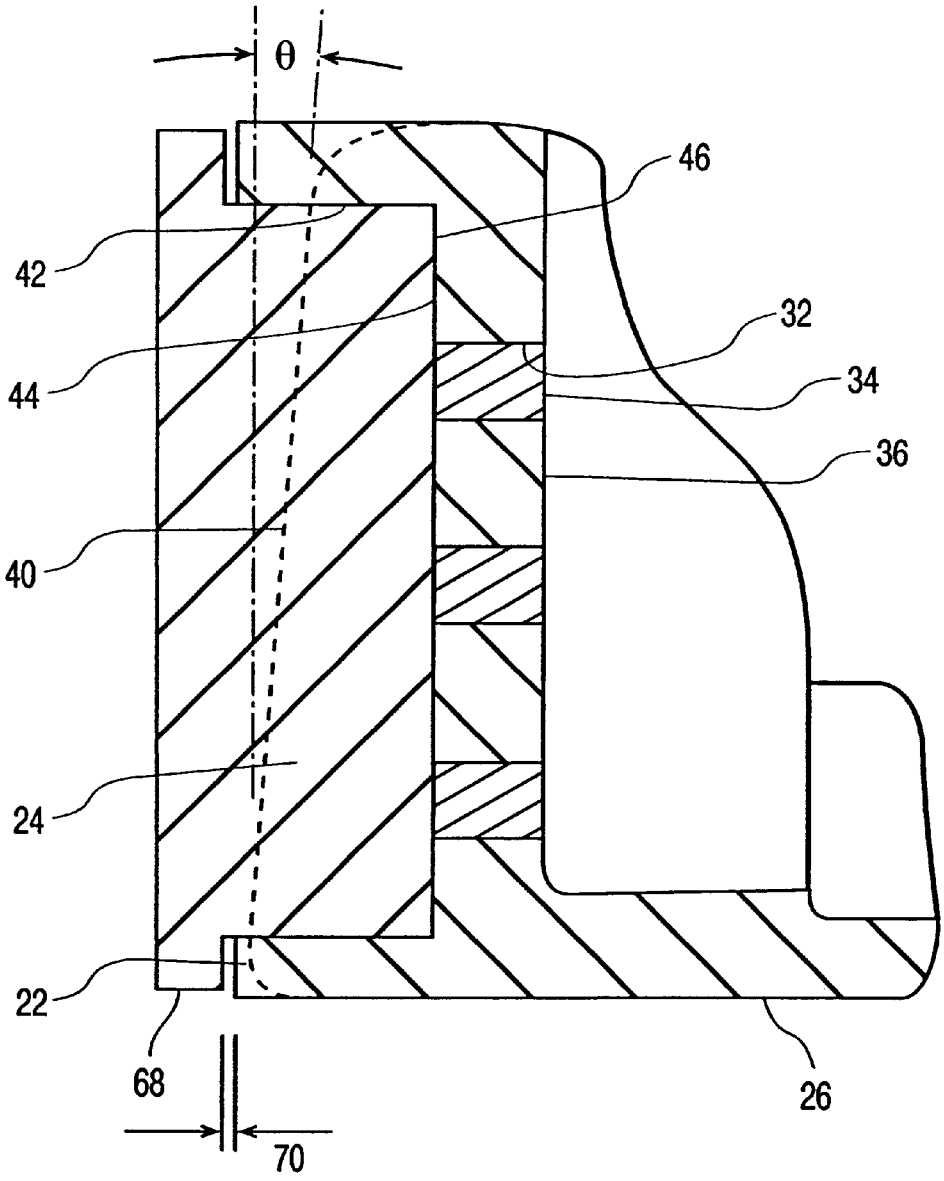
FIG. 6 is a cross-sectional view similar to FIG. 3 showing the insert positioned in the strike face side of the club head before the final machining operation.

FIG. 5 shows an exploded view of the club head 14 prior to assembly. The insert back face 46 hag four threaded holes 56*a*, 56*b*, 56*c* and 56*d* that are complimentary to the clearance holes 52*a*, 52*b*, 52*c* and 52*d*. The insert 24 has a flange 68 and is press fit into the insert strike face 42 with an arbor press with the arbor press applying pressure to the flange 68 so that the insert back face 46 is in full contact with the recess bottom surface 44 after insertion. As shown in FIG. 6, the insert 24 bottoms out against the recess bottom surface 44. The insert 24 is deeper than the depth of the strike face recess 42 so that the insert 24 bottoms out and so that there is a gap 70 between the flange 68 and the club head 14. The four fasteners 58*a*, 58*b*, 58*c* and 58*d* are then fastened into the insert 24, which further connects the insert 24 into the strike face recess 42. Then during a machining process, the flange 68 is then machined off as the strike surface 22, the insert 24 and the loft of the club are defined. Finally, the elastomeric material 34 is inserted into the apertures 32 and into the outermost apertures 50. A squeegee is scraped across the back face 36 to remove the excess silicone, leaving the silicone in each of the apertures, which also covers the heads of the fasteners so that the fasteners are not visible from the back face 36.

Figure 7:
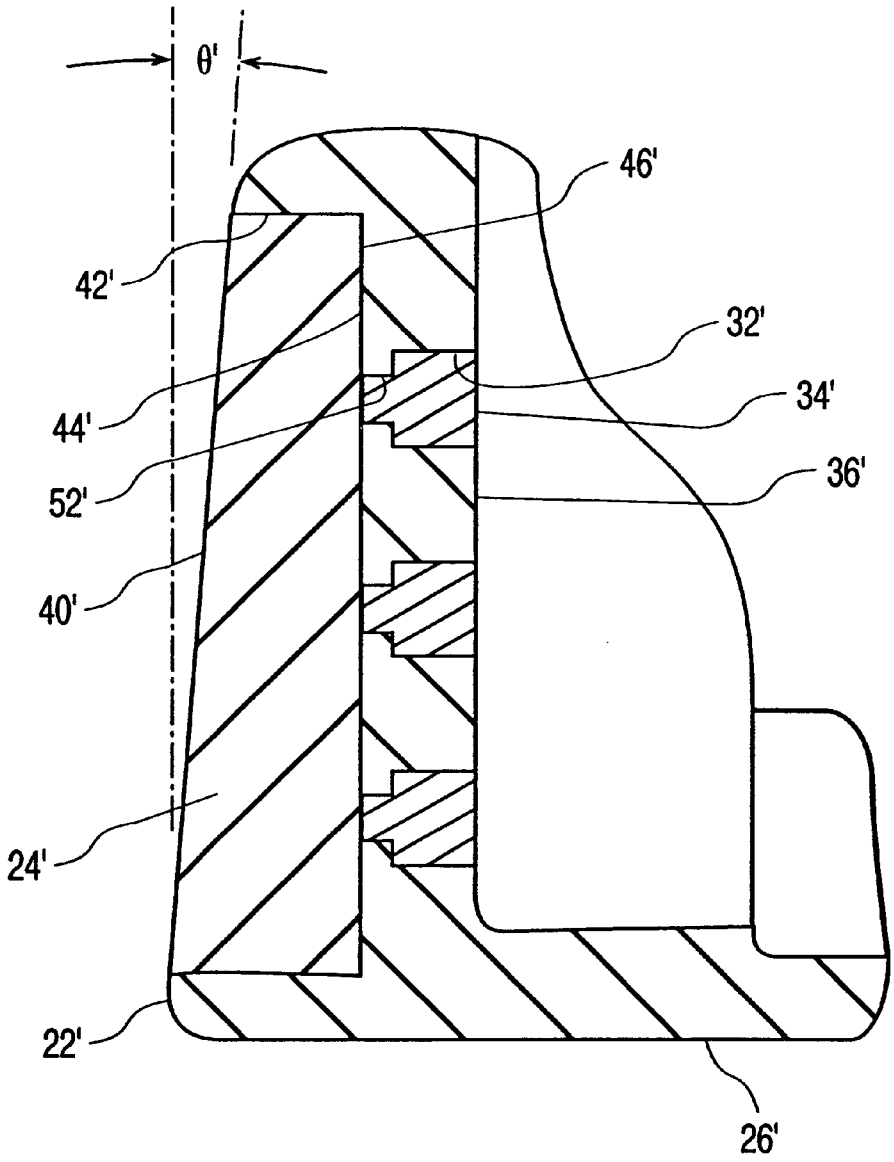
FIG. 7 is a cross-sectional view similar to FIG. 3 showing a separate embodiment of the golf club head of the present invention.

In FIG. 7, the embodiment shown is essentially the same as described above, except that all of the apertures are counterbored. This embodiment reduces the amount of silicone material 34' that is in contact with the insert 24', which in turn affects the touch and feel of the club. The clearance holes 52', as in the above described embodiment, have a diameter of approximately 0.06–0.08 inches.

Figure 8:
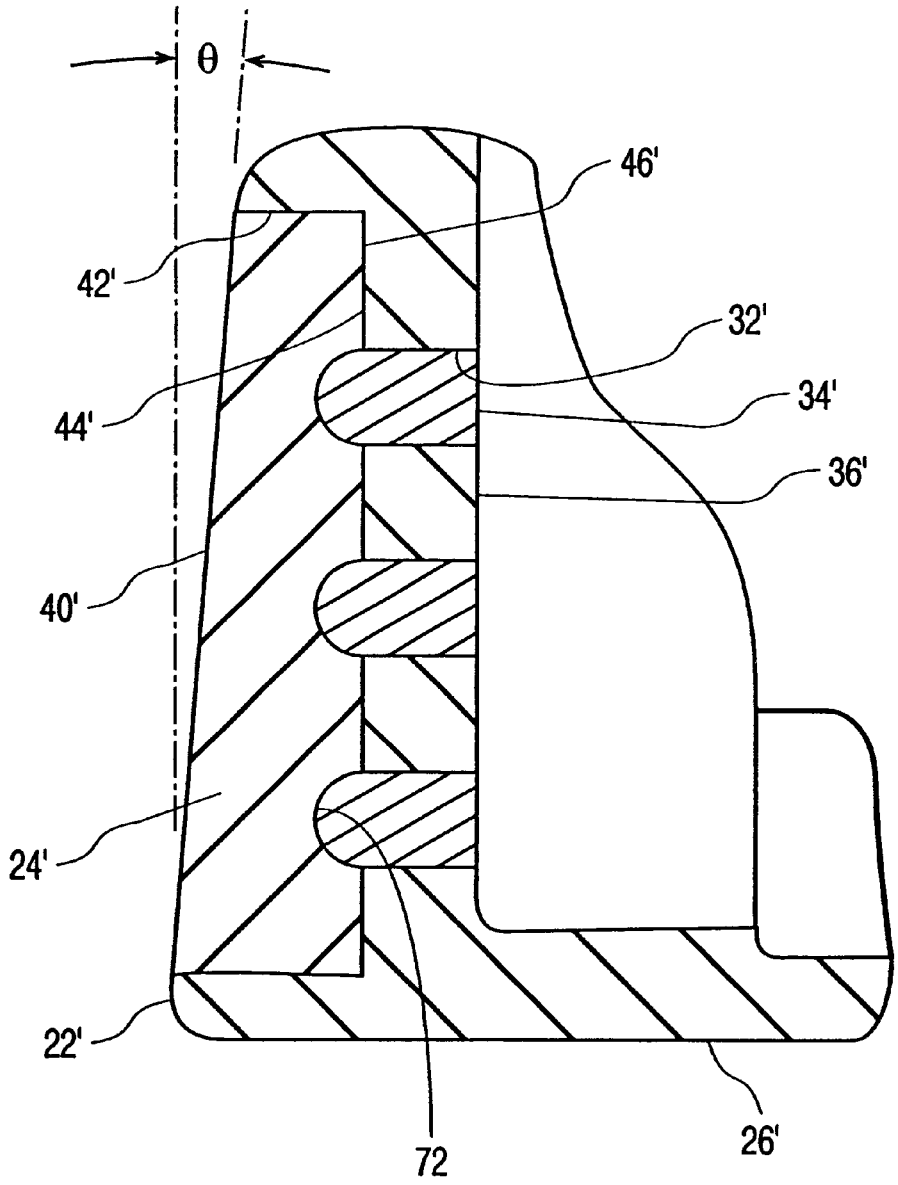
FIG. 8 is a cross-sectional view similar to FIG. 3 showing a separate embodiment of the golf club head of the present invention.
Figure 9:
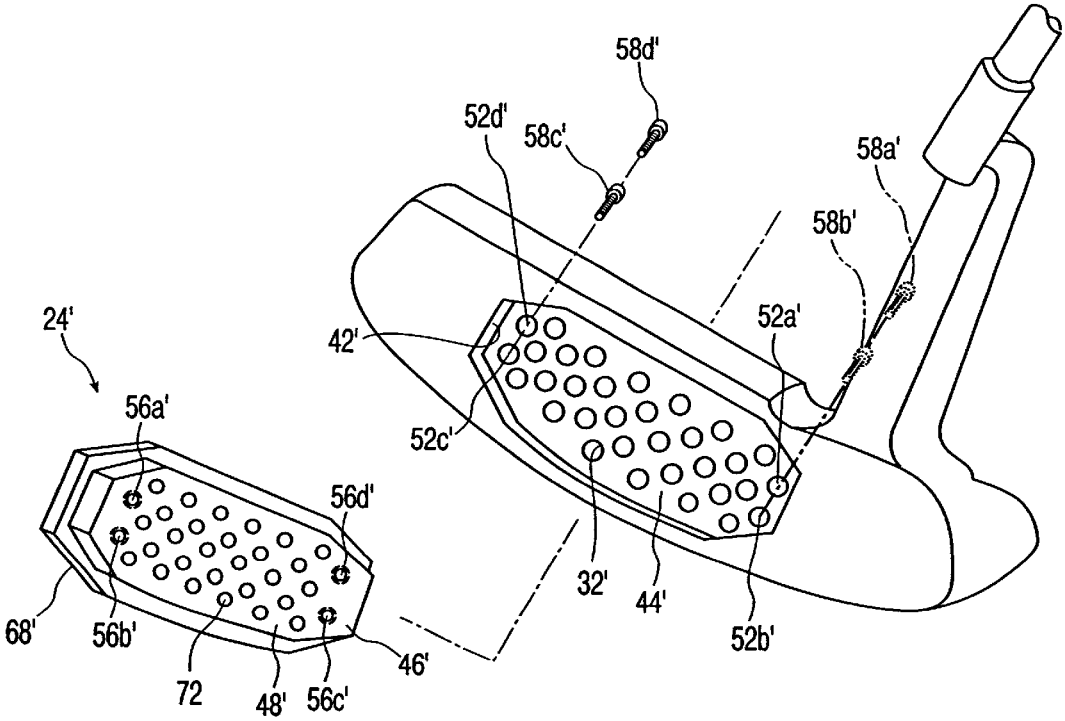
FIG. 9 is an exploded front perspective view of the embodiment shown in FIG. 8 showing the golf club head before assembly.

A separate embodiment is shown in FIGS. 8–9, which is similar to the above disclosed embodiment shown in FIG. 3, except that the insert 24' has a plurality of insert cavities 72. The insert cavities 72 are aligned to be complementary to the plurality of apertures 32'. This embodiment provides a more pronounced vibration dampening feature than the embodiment disclosed in FIG. 3 since the elastomeric material 34' extends into the insert back face 46'.

Figure 10:
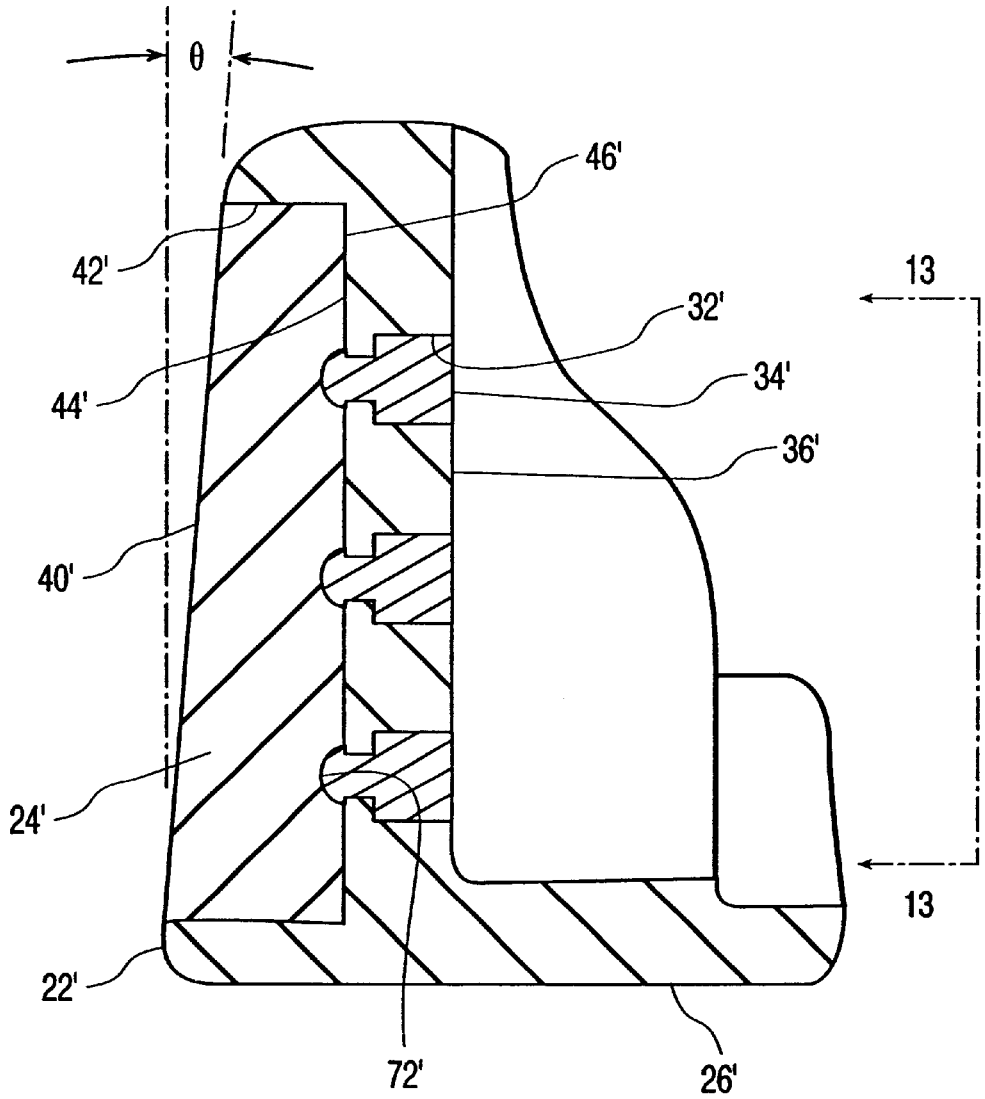
FIG. 10 is a cross-sectional view similar to FIG. 3 showing a separate embodiment of the golf club head of the present invention.
Figure 11:
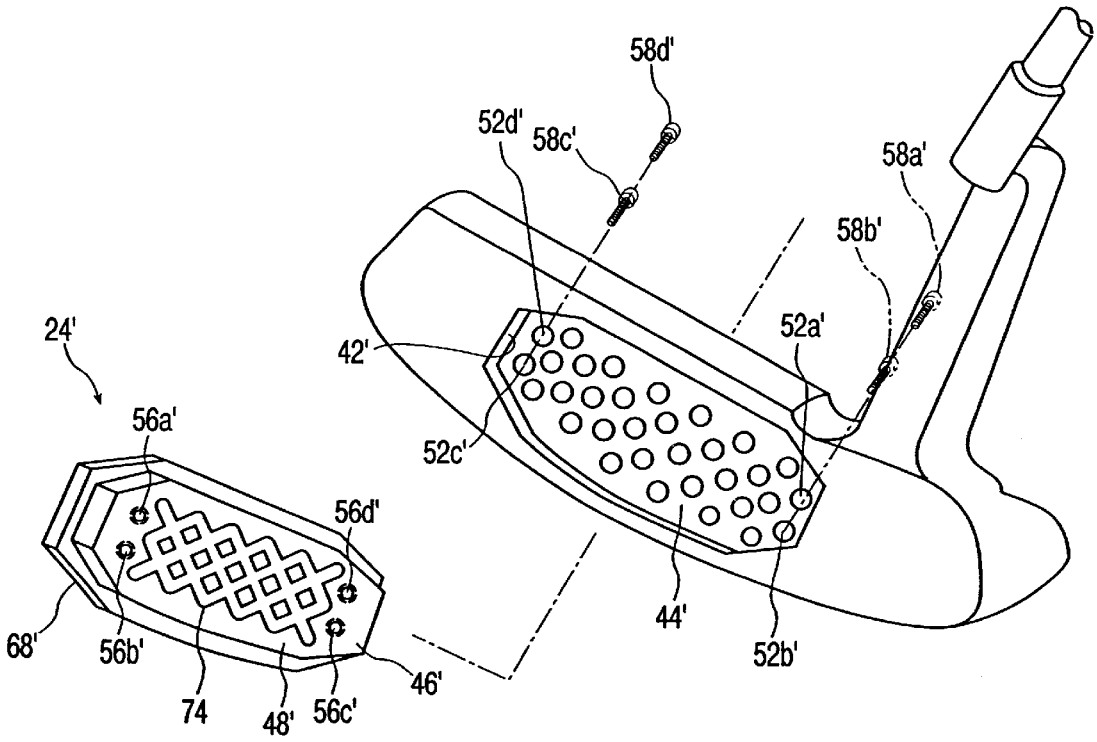
FIG. 11 is an exploded front perspective view of the embodiment shown in FIG. 10 showing the golf club head before assembly.
Figure 12:
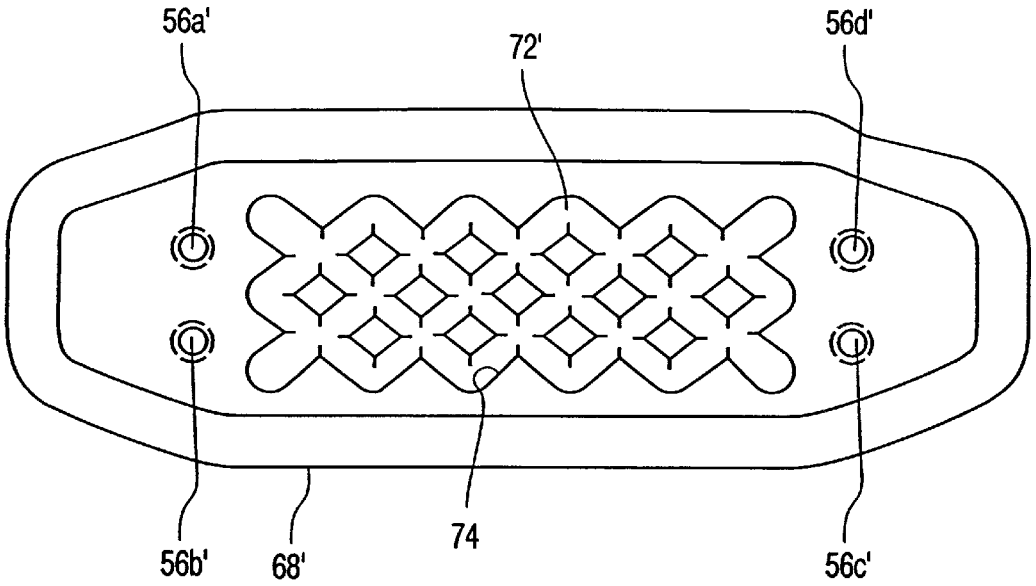
FIG. 12 is an elevational view taken from line 12—12 of FIG. 11 showing the back face of the insert.

Yet another embodiment is shown in FIGS. 10–13. FIG. 10 is similar to the cross-sectional view of FIG. 8. This embodiment is similar to the embodiment shown in FIGS. 8–9, except that all of the apertures are counterbored, as disclosed in the embodiment shown in FIG. 7, and that the insert back face 46' has a continuous passageway 74, or a matrix, that connects each of the insert cavities 72'. The passageway is made with a 1/16 inch ball end mill. The continuous passageway 74 provides a more pronounced vibration dampening feature than the embodiment disclosed in FIGS. 3 and 8 since the elastomeric material 34' extends into the insert back face 46' and since it encompasses more area on the insert back face 46'.

Figure 13:
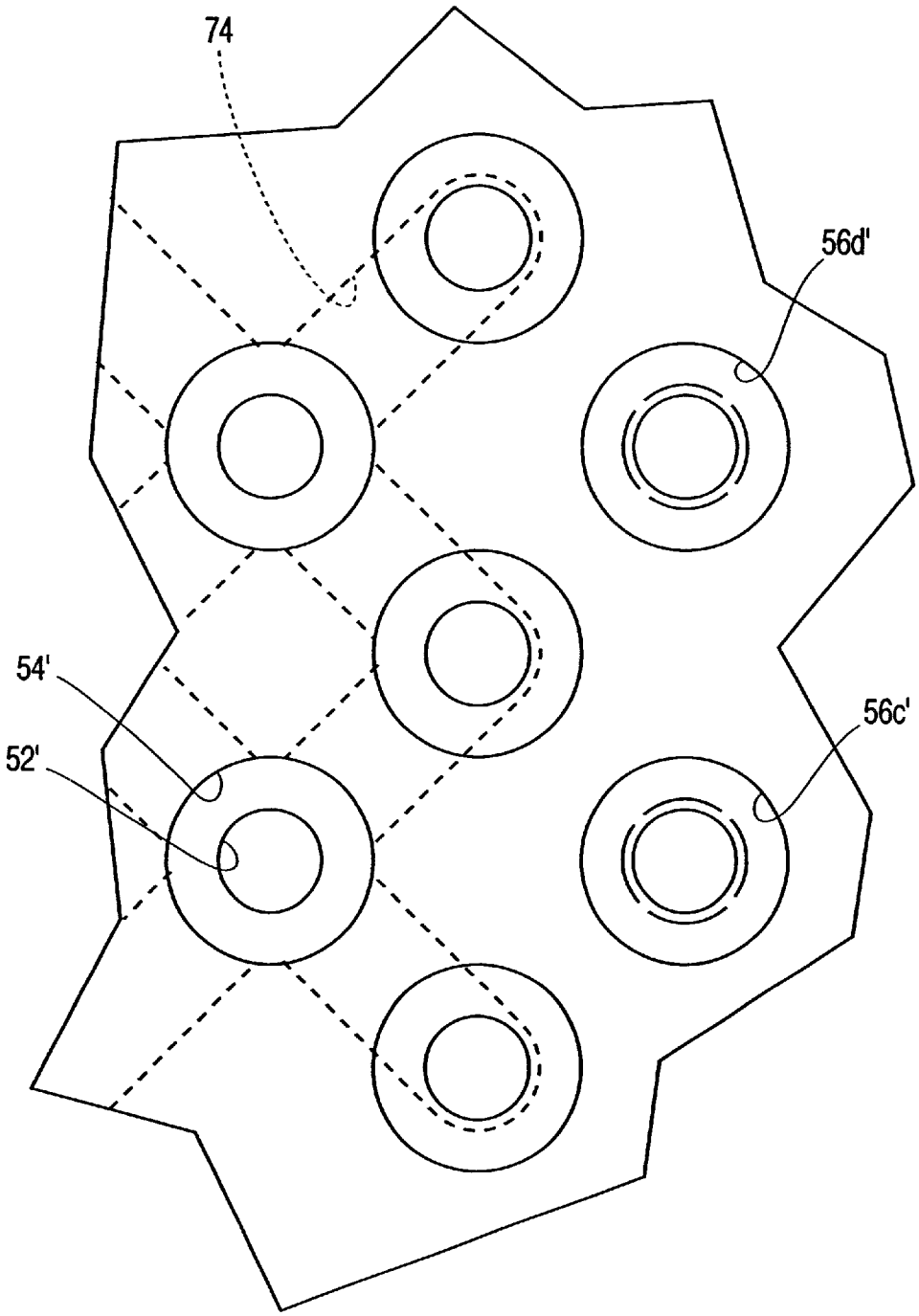
FIG. 13 is a view taken from line 13—13 of FIG. 10 showing the club head back face with the elastomeric material and the fasteners removed.

FIG. 13 shows the club head assembled, but without the fasteners and the silicone material in the apertures, with the passageway 74 being aligned with each of the apertures.

Figure 14:
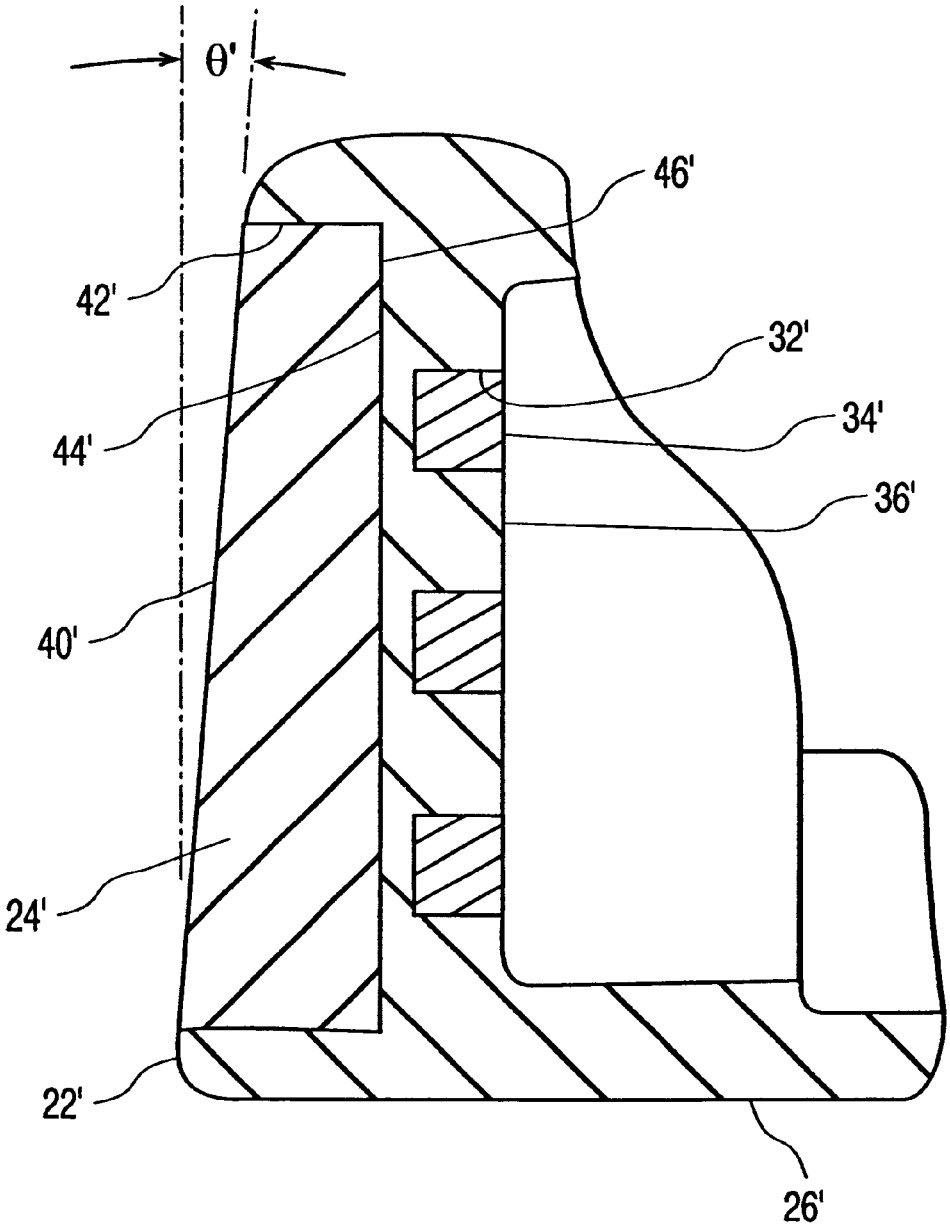
FIG. 14 is a cross-sectional view similar to FIG. 3 showing a separate embodiment of the golf club head of the present invention.

Another embodiment is shown in FIG. 14, which is similar to the embodiment shown in FIG. 3, except that the apertures 32' do not extend into the strike face recess 42'. This embodiment provides a lesser amount of vibration dampening compared to the other above described embodiments.

Figure 15:
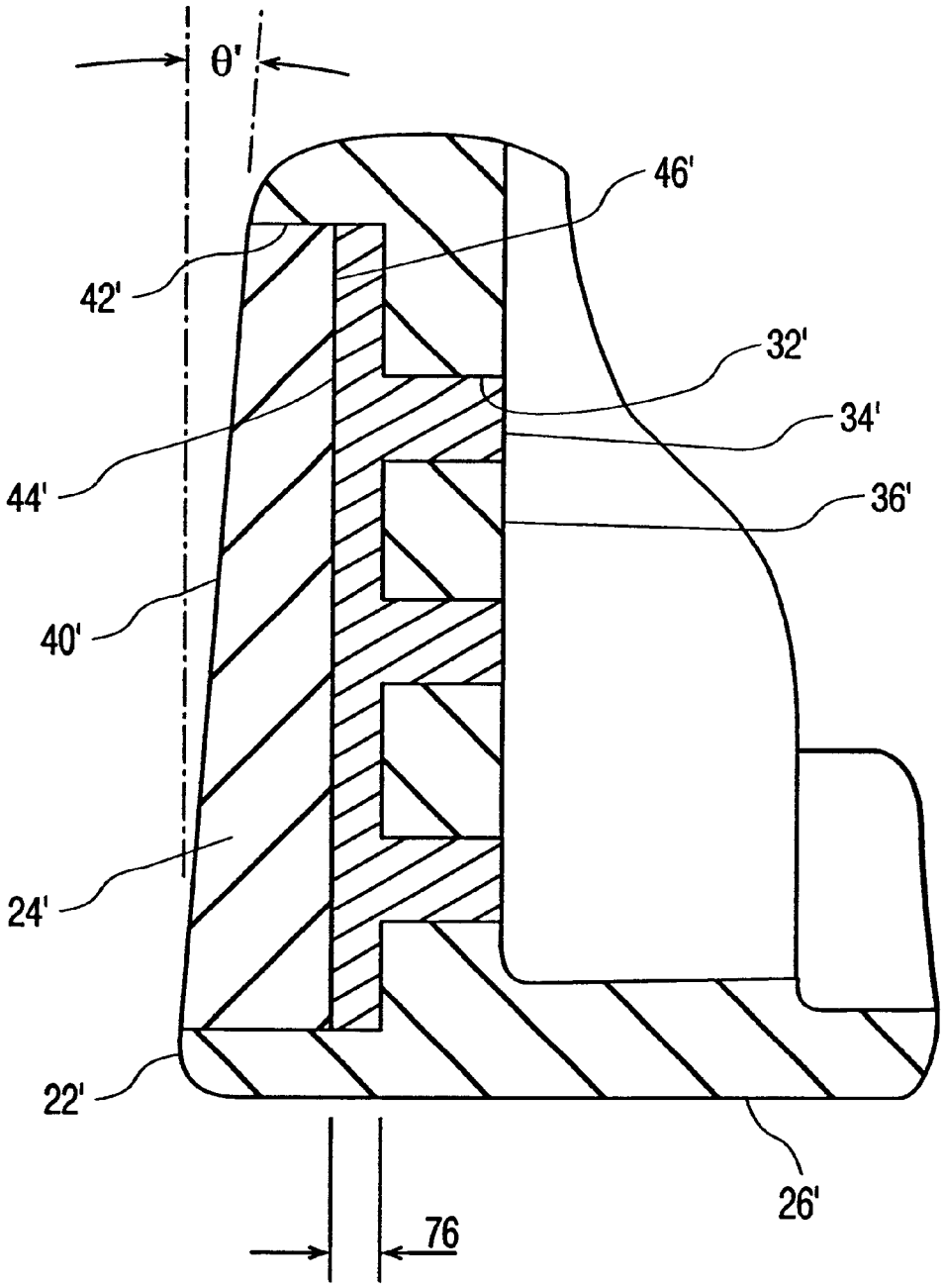
FIG. 15 is a cross-sectional view similar to FIG. 3 showing a separate embodiment of the golf club head of the present invention.
Figure 16:
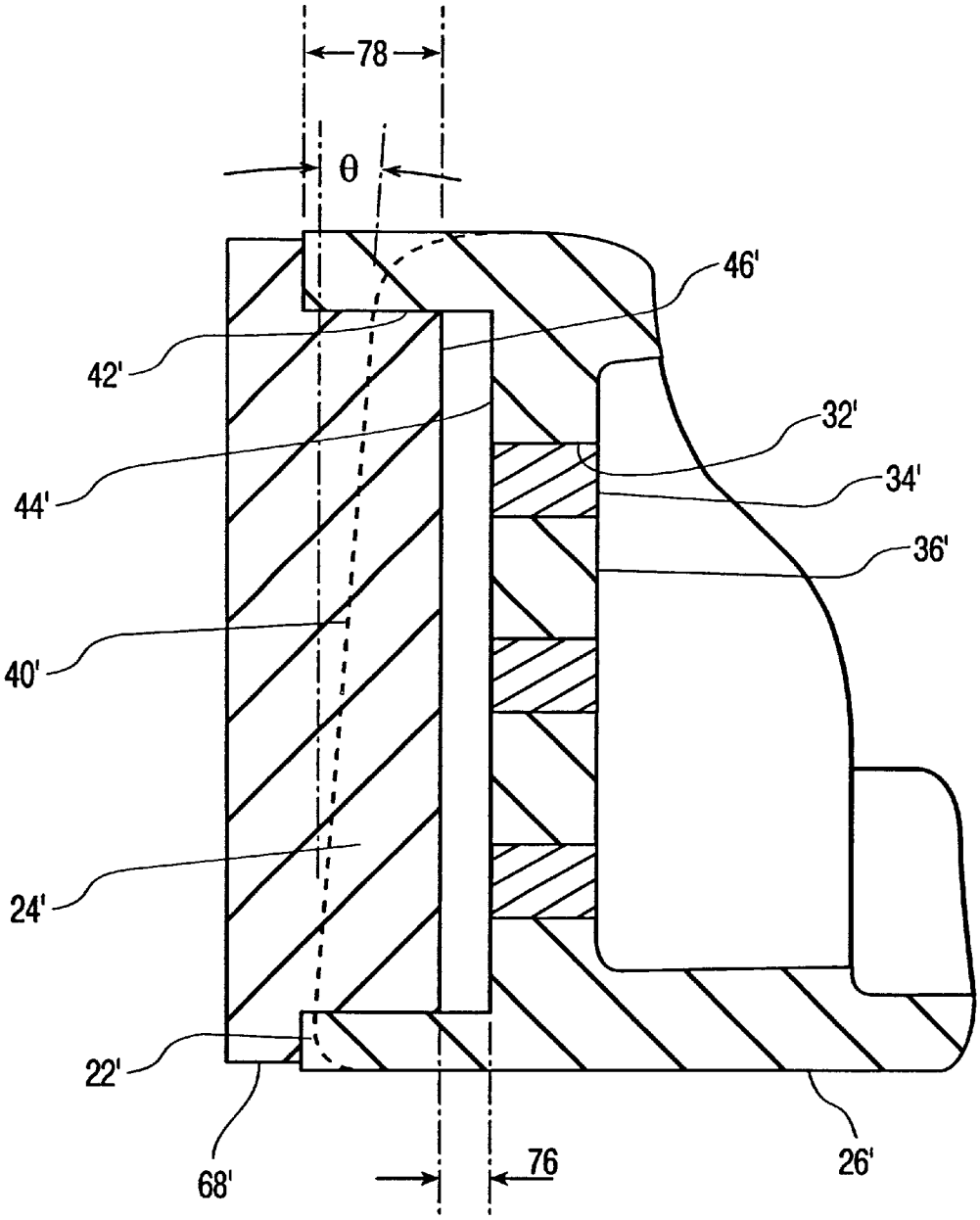
FIG. 16 is a cross-sectional view similar to FIG. 6 showing the insert positioned in the strike face side of the club head before the final machining operation.

Yet another embodiment is shown in FIGS. 15–16, which is similar to the embodiment described in FIG. 3, except that there is a gap 76 between the insert back face 46' and the strike face recess bottom surface 44'. As shown in FIG. 16, the gap 76 may be predetermined by a flange to insert back face dimension 78, so that when the insert 24' is press fit into the strike face recess 42', the gap dimension is determined. A second vibration dampening means, such as foam rubber, may be inserted in the gap 76. In the alternative, the gap 76 is filled with elastomeric material 34'. The flange 68' is then machined off, as described in detail above.

Figure 17:
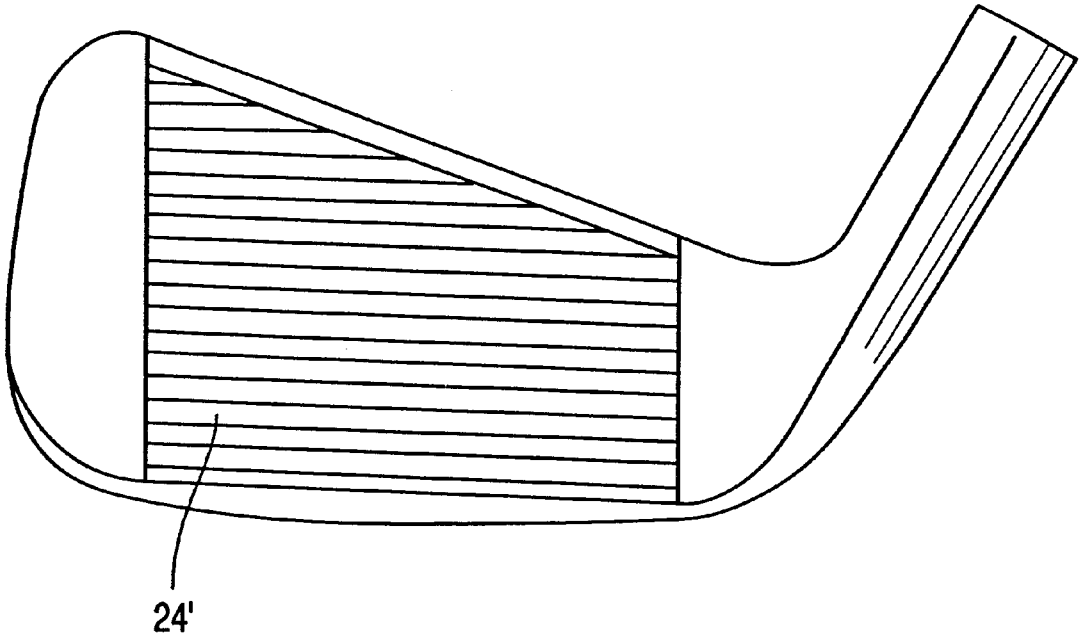
FIG. 17 is a front perspective view of a separate embodiment of a golf club head of the present invention showing an insert located on a strike face of an iron-type club.
Figure 18:
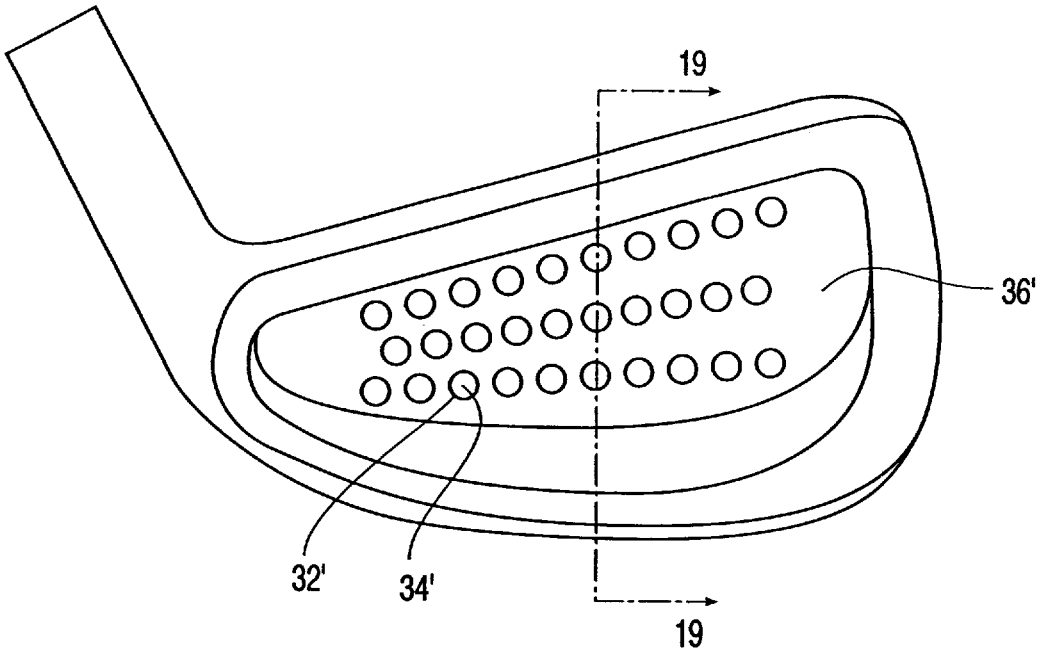
FIG. 18 is a rear view of the golf club head shown in FIG. 17 showing a plurality of apertures spaced apart on a back face of a club head.
Figure 19:
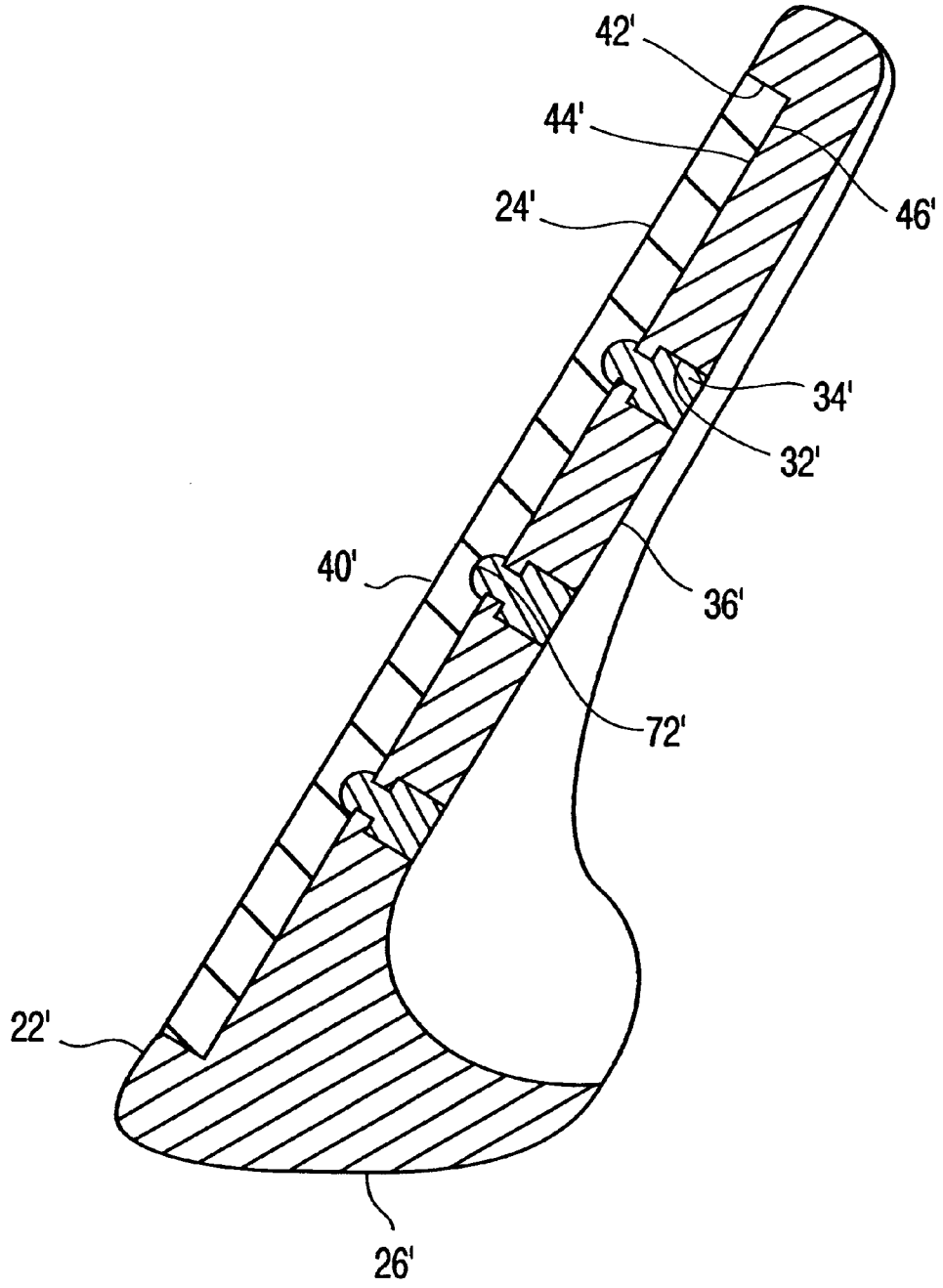
FIG. 19 is a cross-sectional view taken from line 19—19 of FIG. 18 showing the apertures filled with an elastomeric material.

Yet another embodiment is shown in FIGS. 17–19, which is similar to the above described embodiment shown in FIGS. 10–13, except that the club shown is an iron-type club. In this embodiment, the insert 24' material should be a harder material, such as titanium, for the low lofted clubs (2–4 irons), a softer material, such as steel, for the medium lofted clubs (5–7 irons), and yet a softer material, such tellurium copper, for the high lofted clubs (8-wedges).

Figure 20:
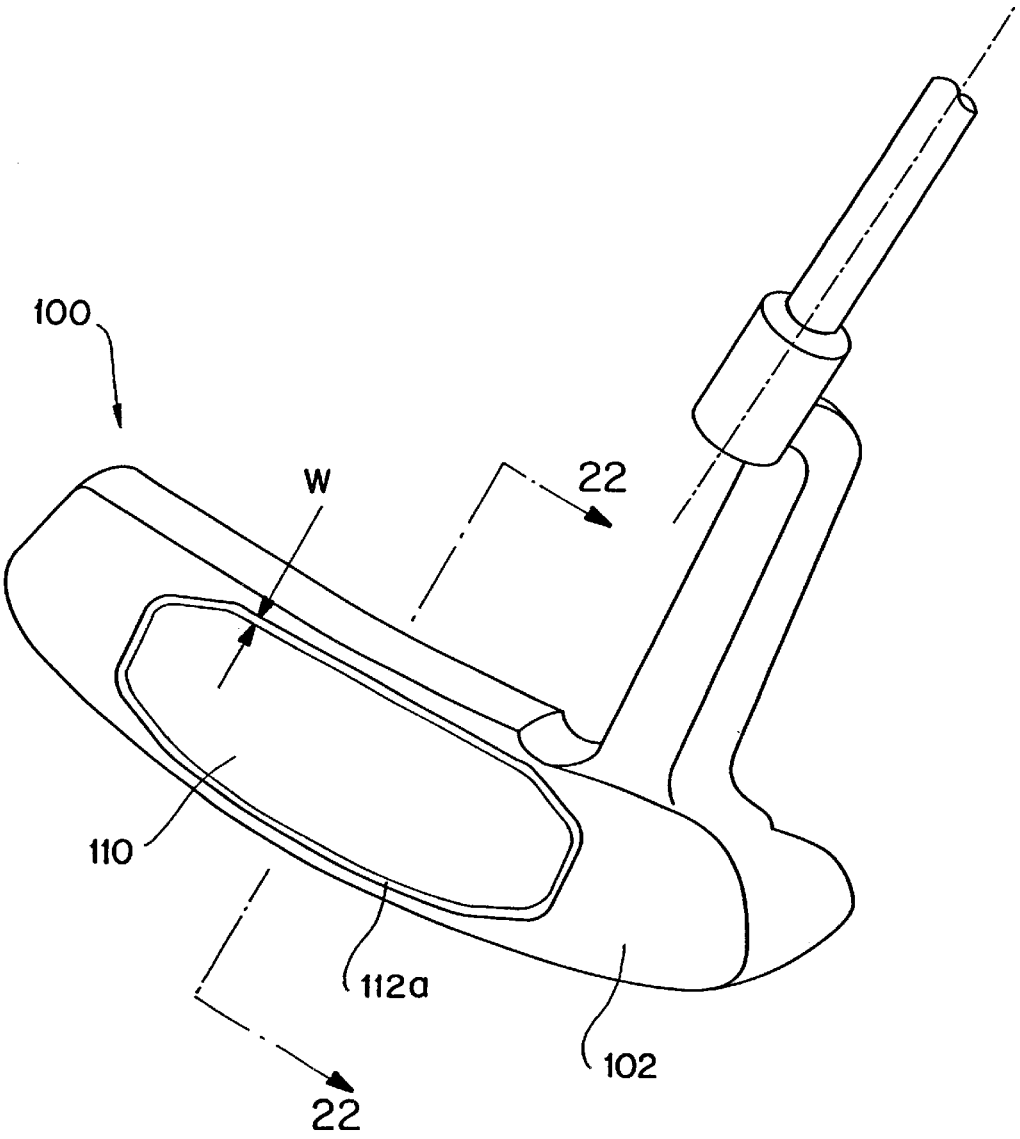
FIG. 20 is a front perspective view of another embodiment of the golf club head of the present invention showing the insert located on a strike face with an elastomeric material there around.
Figure 21:
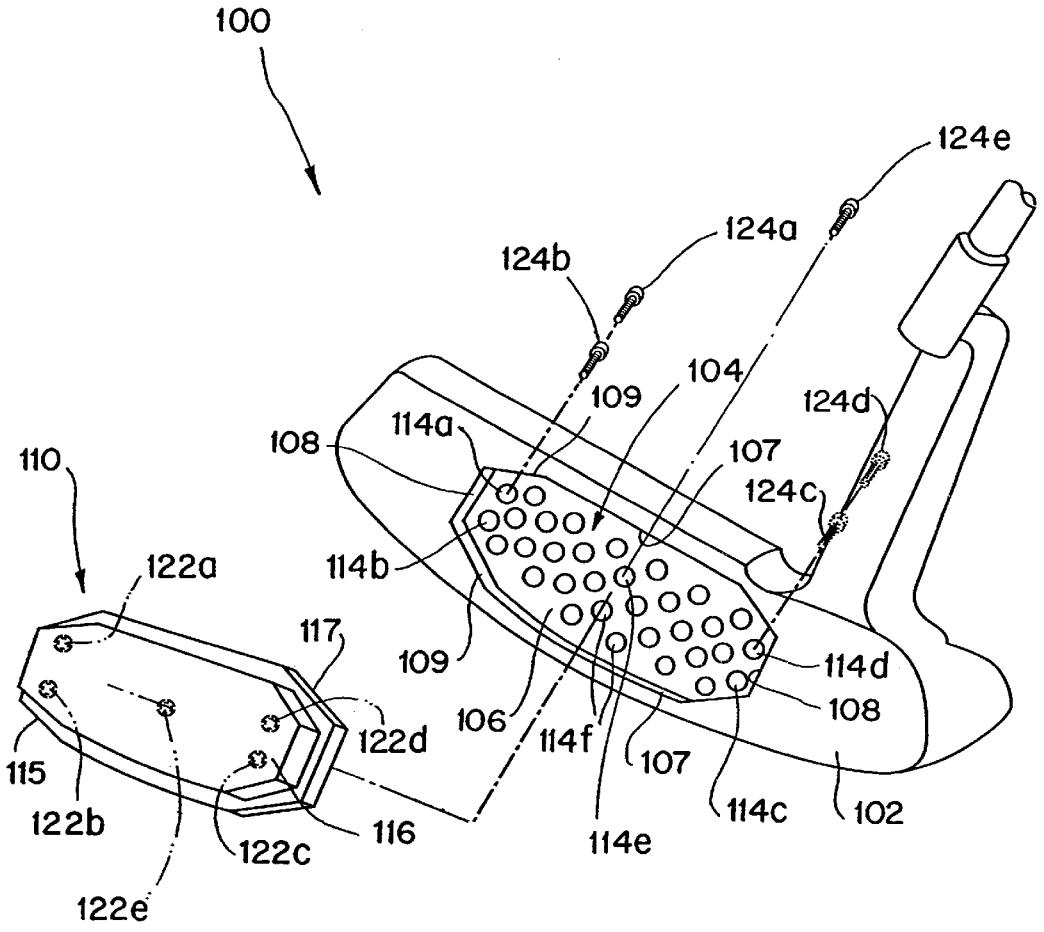
FIG. 21 is an exploded front perspective view of the golf club head of FIG. 20 before assembly.
Figure 22:
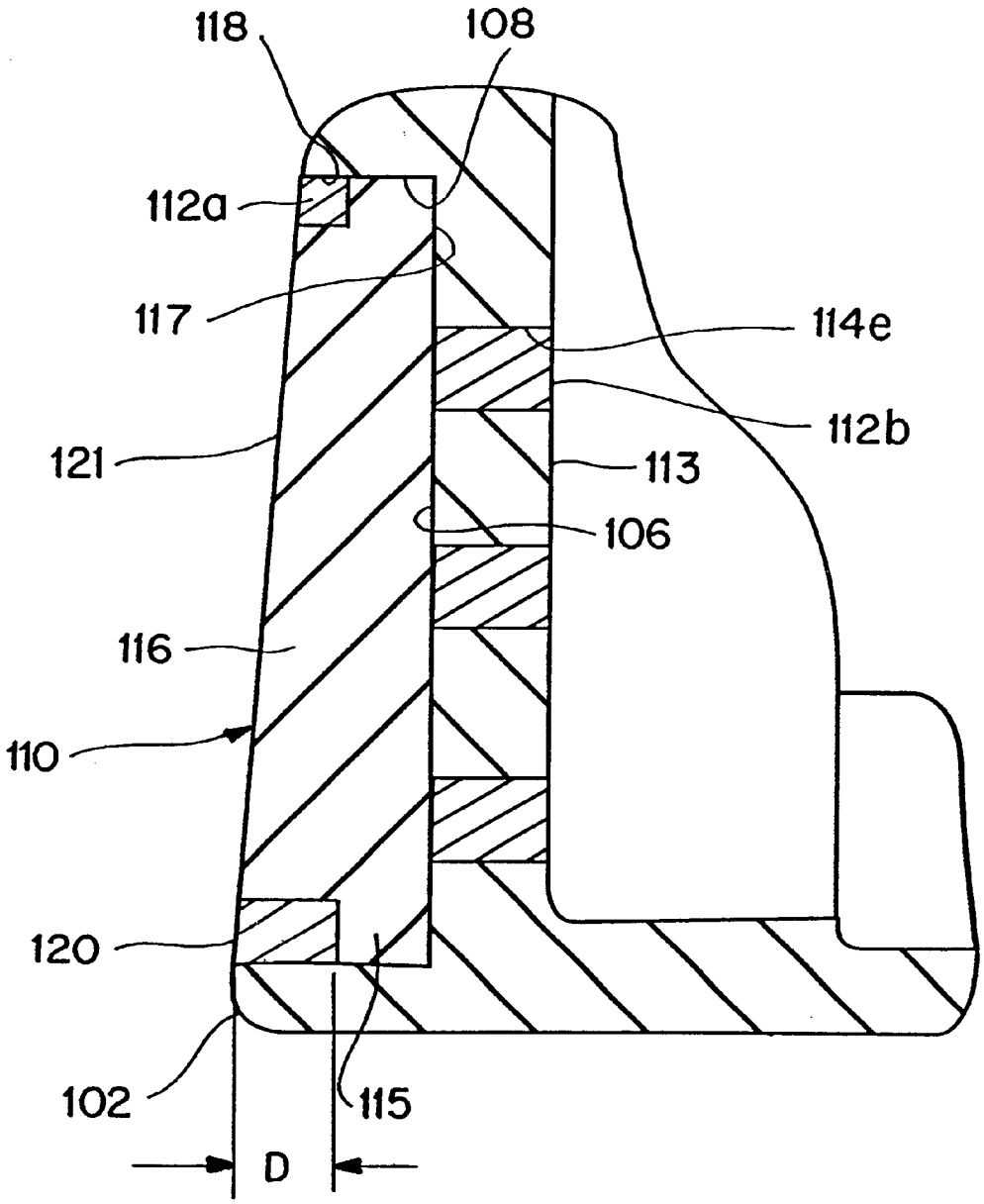
FIG. 22 is a cross-sectional view taken along line 22—22 of FIG. 20 showing a space and apertures filled with an elastomeric material.

Another embodiment is shown in FIGS. 20–22, which is similar to that discussed with respect to FIGS. 1–5. The club head 100 has a strike face 102 that defines a recess 104 having a bottom surface 106 and a side wall surface surrounding the bottom surface 106. The side wall surface includes a plurality of portions 107–109. The pair of horizontal side wall portions 107 are substantially parallel to one another, and generally horizontal. The pair of vertical side wall portions 108 are substantially parallel to one another, and generally vertical. The four corner side wall portions 109 extend between adjacent horizontal and vertical side wall portions to form an angled surface.

The recess 104 receives an insert 110 and a first vibration dampening material 112*a*. The club head 100 further includes a flat back face portion 113, as described with respect to FIG. 2. The back face portion 113 defines a plurality of apertures 114*a–f* that are preferably evenly spaced apart in relation to each other, that follow the contour of the back face portion 113 and that are essentially perpendicular to the strike face 102. The apertures 114*a–f* extend from the back face portion 113 to the bottom surface 106 of the recess 104. Preferably more than five apertures are used, more preferably there are greater than 20 apertures, and most preferably there are 32 apertures. The apertures 114*a–*114*d* are clearance holes, the aperture 114*e* is a central aperture, and the remaining apertures are apertures 114*f*.

Referring to FIGS. 21 and 22, the integrally formed insert 110 includes a first portion or flange 115 and a second or platform portion 116. The flange 115 extends radially outwardly from the platform portion 116. The insert 110 further includes a back face 117.

The flange 115 is sized to fit within the recess. When the insert 110 is inserted in the recess 104, the back face 117 is in contact with the bottom surface 106 of the recess 104. Furthermore, the flange 115 is disposed adjacent and in contact with the bottom wall 106 and the side wall surface portions 107–109. In the installed position, the platform portion includes the outer peripheral edge which is spaced from at least a portion of the side wall surface to define a peripheral groove 118 between the platform portion 116 and the side wall surface. The flange 115 centers the insert within the recess. The peripheral groove 118 surrounds the platform portion 116 of the insert. The groove 118 has a width, designated by the arrow w in FIG. 29. The width w is preferably about 0.040 inches.

The first vibration dampening material 112*a* is disposed in the groove 118 around the insert 110. The first vibration dampening material 112*a* substantially fills the groove 118 and has a front surface 120 which is essentially axially aligned with the club head strike face 102 and the insert strike face 121. The depth of the first vibration dampening material is designated by the arrow D in FIG. 22. The depth can be constant around the insert or varied.

Turning to FIG. 21, the insert back face 117 includes five threaded holes 122*a–*122*e* (shown in phantom). The holes 120*a–*120*e* are complimentary to the apertures 114*a–*114*e* in the club head 100. The five fasteners 124*a–*124*e* are fastened into the insert holes 120*a–*120*e*. The fasteners 124*a–*124*e* connect the insert 110 to the club head. During machining of the loft in the putter, the fasteners aid in maintaining the connection between the insert and the club head. After machining, the center fastener 124*e* is removed from the insert hole 122*e*. The purpose of the center fastener 124*e* is to aid in maintaining the connection between the insert and the club head during machining.

The second vibration dampening material 112*b* is disposed in at least one of the apertures 114*a*–f in the club head 110. More preferably, the second vibration dampening material 112*b* is disposed in all of the apertures 114*a–f*.

In the preferred embodiment, the vibration dampening material 112*a* and 112*b* is an elastomeric material that is deformable. In the most preferred embodiment, the elastomeric material is a silicon material. One example of a recommended silicon material is commercially available under Stock No. GE281 from General Electric Company in Waterford, N.Y.

Using the first vibration dampening material 112*a* on the strike face in addition to the second vibration dampening material 112*b* in the back face portion provides more pronounced vibration dampening, than the embodiment shown in FIG. 2 since the vibration dampening material 112*a* and 112*b* encompasses more area on the insert.

Referring to FIG. 21, in other embodiments the back face 117 of the insert can be modified to accommodate different amounts of the vibration dampening material. For example, as discussed with respect to FIGS. 8–9, in one preferred embodiment the back face can include the insert cavities 72. In another embodiment, as discussed with respect to FIGS. 10–13, the insert back face can have the continuous passageway 74. Furthermore, the geometry of the apertures 114*a–*114*e* can be modified. As shown in FIGS. 7 and 10, so that the apertures are counterbored. As shown in FIG. 14, the apertures can also be modified so that they do not extend into the strike face recess.

Figure 23:
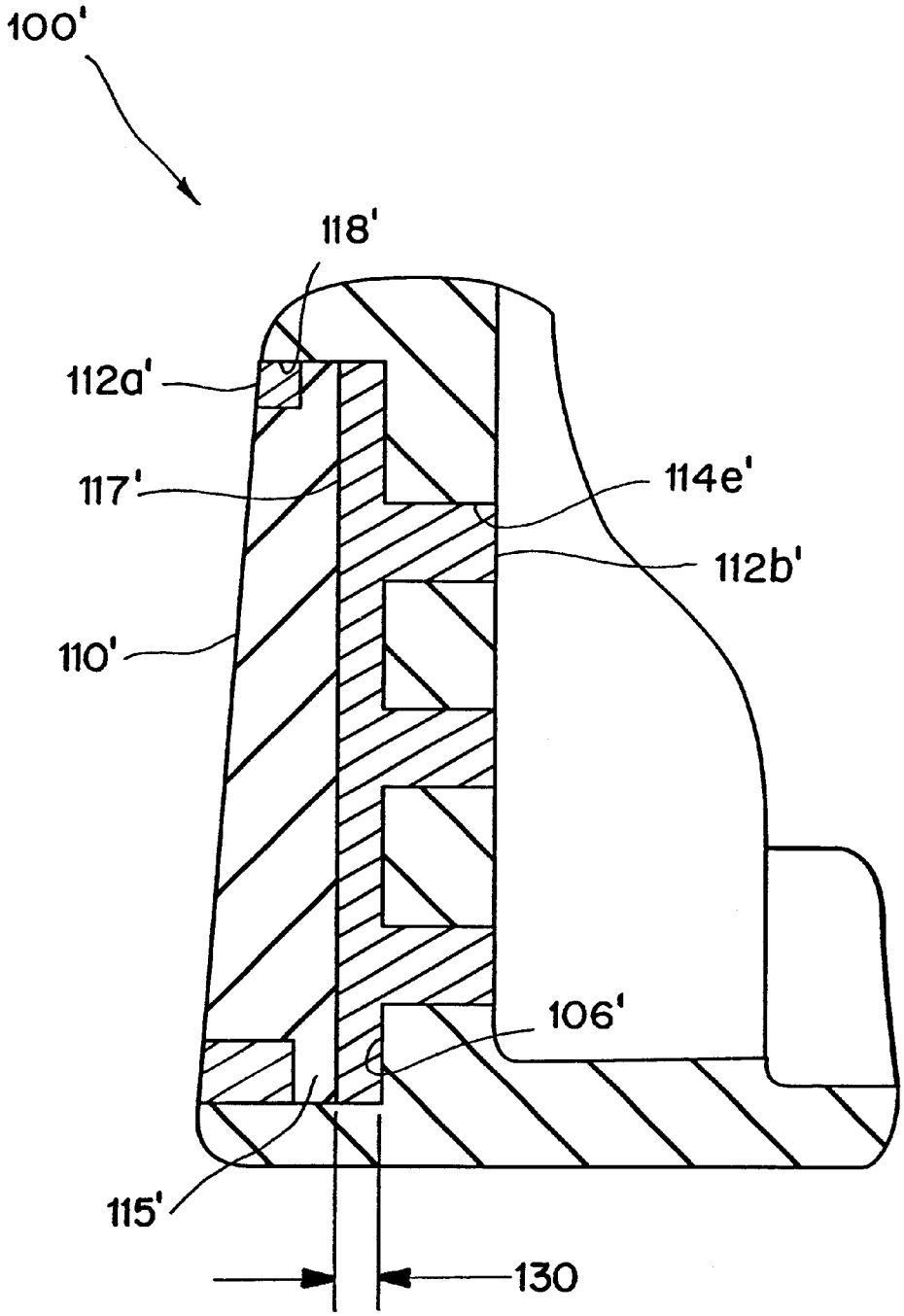
FIG. 23 is a cross-sectional view similar to FIG. 22 wherein the insert defines a gap, a space, and apertures filled in an elastromeric material.

Referring to FIG. 23, the insert 110' has the flange 115' and is dimensioned so that a gap 130 is defined between the insert back face 117' and the bottom surface 106' of the recess. The gap 130 and the apertures 114*e'* are filled with the second vibration dampening material 112*b'*. The club head 100' includes the groove 118' and the first vibration dampening material 112*a'* is disposed within the space 118'. In another embodiment, the gap 130 can be filled with a vibration dampening material that is different from that used in the apertures 114*e'*. For example, foam rubber can be used in the gap or another elastomeric material.

Figure 24:
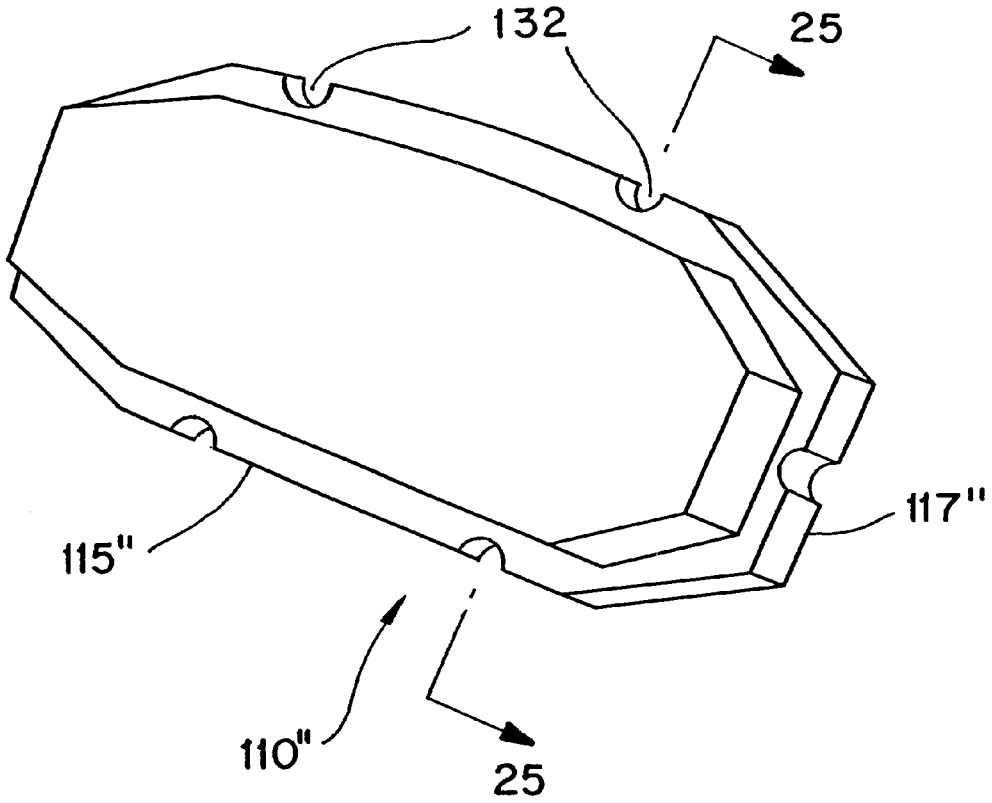
FIG. 24 is an enlarged perspective view of another embodiment of the insert for use with the club head shown in FIGS. 20 and 21.
Figure 25:
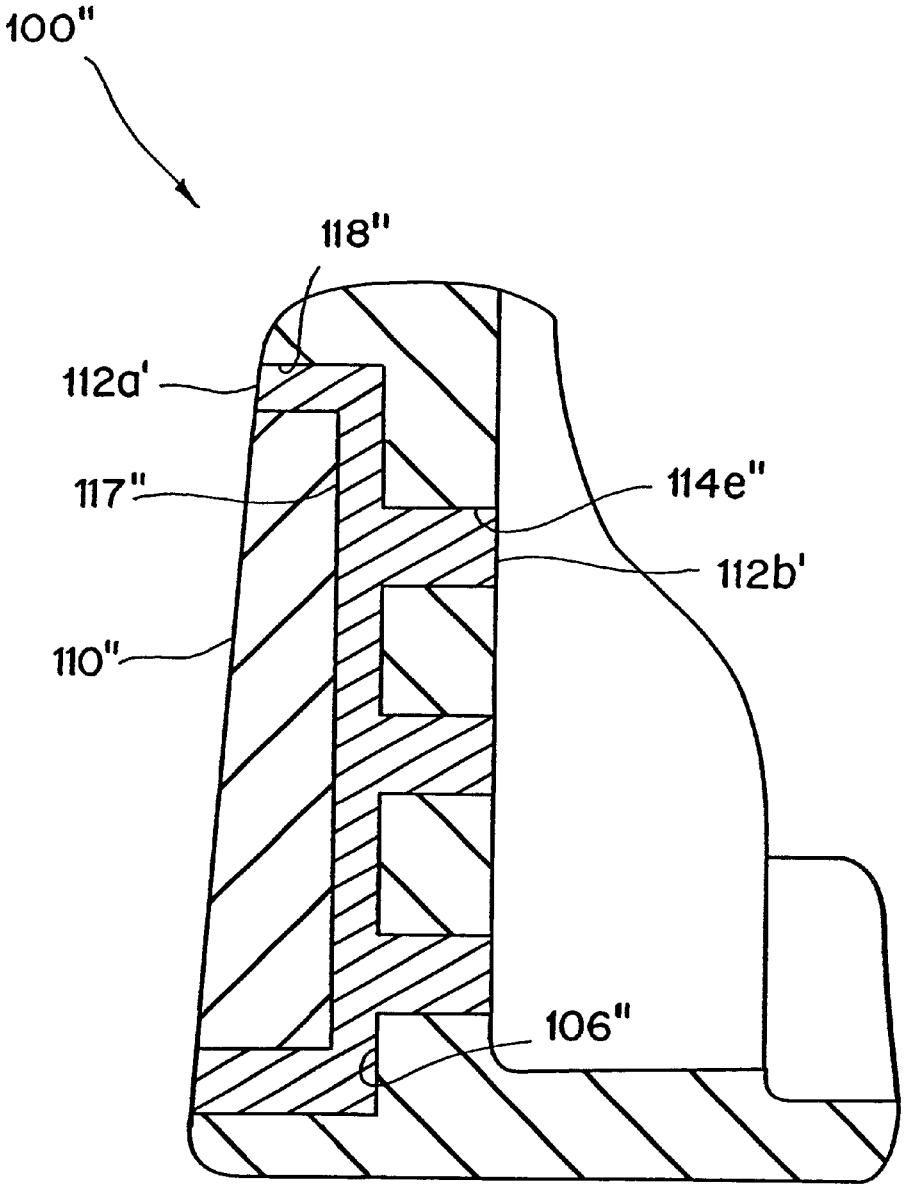
FIG. 25 is a cross-sectional view along the line 25—25 of FIG. 24 showing the insert of FIG. 24 assembled in a club head.

Referring to FIG. 24, the insert 110" includes a flange 115" similar to that in FIGS. 20–22. However, the flange 115" defines a plurality of circumferentially spaced notches 132. Referring to FIG. 25, when the insert 110" is disposed in the club head 100" so that a gap 130 is defined. The notches 132 define passages between the groove 118' and the gap 130. The notches 132 allow the second vibration dampening material 112*b'* from the gap to communicate with the first vibration dampening material 112*a'* in the groove so that the vibration dampening material is continuous from the strike face to the back face portion. The size and the shape of the notches may vary.

Figure 26:
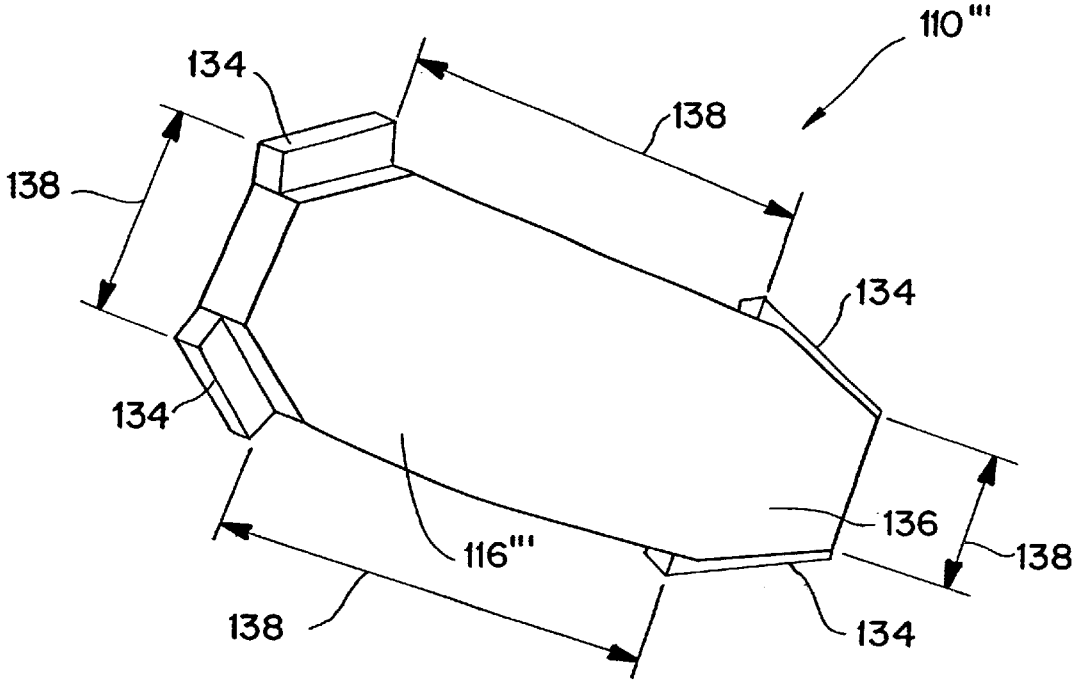
FIG. 26 is an enlarged perspective view of another embodiment of the insert for use with the club head shown in FIGS. 20 and 21.

Referring to FIG. 26, the insert 110"' includes a plurality of spaced first portions or projections 134 defining spaces 118"' there between. The projections 134 extend radially outwardly from the platform portion 116"'. The projections 134 are not flush with the front face 136. When the insert is installed in the club head recess, the projections are in contact with a portion of the side wall surface, more specifically, the angled side wall surface portions 109 (as best shown in FIG. 21). The projections 134 center the insert within the recess. There should be a large enough number of projections so that the insert can be located accurately within the recess. The preferred number is four. When the insert is disposed into the club head, a gap 130 (as shown in FIG. 23) is defined. The platform portion 116"' defines the peripheral groove in the strike face. The first vibration dampening material is disposed in the peripheral groove. The spaces 138 between the projections 134 are passageways that allow the second vibration dampening material from the gap 130 to communicate and be continuous with the first vibration dampening material in the groove. The size and the shape of the projections 134 may vary.

During manufacture, in order to introduce the elastomeric material into the club head, it is injected into the apertures and it flows to the gap and groove. A squeegee is scraped across the back face and the strike face to remove the excess silicone, leaving the silicone in each of the apertures and the groove.

The inserts shown in FIGS. 24 and 26 can also be used without the gap as shown in FIG. 22. This will allow the amount of vibration dampening material in the recess to vary, thus providing different levels of dampening.

The amount of vibration dampening material in the club head can be varied in a number of ways. For example, the number of apertures or number of apertures filled with the vibration dampening material can be varied. In addition, the geometry of the peripheral groove can be varied by changing the width w (as shown in FIG. 20), by changing the depth D (as shown in FIG. 23), by changing the geometry of the flange or projections, or by changing the size of the gap. Varying the amount of vibration dampening material affects the feel of the club head and allows the club head to be custom fit to a particular player or group of players depending on their needs, preferences, and/or performance. If a player, such as a Tour player, prefers more metal-to-metal contact the amount of vibration dampening material can be decreased. If as a group ladies, seniors or juniors, for example, prefer less metal-to-metal contact the amount of vibration dampening material can be increased. Thus, the club head of the present invention allows the manufacturer to modify the club head to satisfy one player or a group of players, which is advantageous.

Referring to FIGS. 6 and 16, the inserts 110, 110', 100", and 110"' can be formed with a second flange, such as 68 or 68' that extend from the face of the insert that will be adjacent the strike face 22 once installed. This second flange is larger than the recess 44 and 44' so that once the insert is installed the second flange is adjacent the strike face 22. Prior to inserting the vibration dampening material into the space, formed as discussed above, the second flange is machined off.

We claim:

1. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion and a side wall surface extending between the bottom surface and the strike face;

b) an insert located in the recess, said insert having a peripheral edge spaced from the side wall surface to form a peripheral groove and a first vibration dampening material located in the peripheral groove, the insert further including a back face having at least one portion of the back face in contact with the bottom surface of the recess, the insert further includes a first portion and a second portion, the first portion is a flange and extends radially outwardly from the second portion, and the first portion is in contact with a portion of the side wall surface and the second portion includes the peripheral edge, and the flange further defines at least one notch; and c) a plurality of apertures extending from said back face portion toward the recess and a second vibration dampening material located in at least one of said apertures.

2. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion and a side wall surface extending between the bottom surface and the strike face;

b) an insert located in the recess, said insert forming a first portion of the strike face, the insert including a first portion that contacts the side wall surface of the recess, and the insert further includes a back face and the back face is spaced from said bottom surface of the recess to define a gap; and c) a vibration dampening material extending continuously from the strike face to the back face portion through the gap, the vibration dampening material forming a second portion of the strike face.

3. The golf club head of claim 2, further including a plurality of apertures extending from said back face portion to the recess, wherein at least one of the apertures has the vibration dampening material located therein.

4. The golf club head of claim 3, wherein the the recess has a bottom surface spaced from the back face portion and a side wall surface extending between the bottom surface and the strike face; the insert has a peripheral edge spaced from the side wall surface to form a peripheral groove, the peripheral groove, gap and at least one aperture are in fluid communication so that the vibration dampening material extends therethrough.

5. The golf club head of claim 4, wherein the vibration dampening material in the peripheral groove is a first portion of the vibration dampening material, the vibration damping material in the at least one aperture is a second portion of the vibration dampening material, and the vibration dampening material in the gap is a third portion of the vibration dampening material, and the first and second portions are the same.

6. The golf club head of claim 4, wherein the second and third vibration dampening material are the same.

7. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion and a side wall surface extending between the bottom surface and the strike face;

b) an insert located in the recess, said insert having a peripheral edge spaced from the side wall surface to form a peripheral groove, and a first vibration dampening material located in the peripheral groove, the insert further including a back face having at least one portion of the back face in contact with the bottom surface of the recess;

c) a plurality of apertures extending from said back face portion toward the recess and a second vibration dampening material located in at least one of said apertures; and d) a fastening means that extends through at least one of said apertures to connect said insert to said back face portion.

8. The golf club head of claim 7, wherein the back face of the insert further includes a plurality of cavities that are aligned to be complementary with said plurality of apertures.

9. A golf club head having a toe and an opposite heel, a sole portion and an opposite top portion, a forwardly facing strike face and an opposite rearwardly facing back face portion, comprising:

a) a recess defined in the strike face, said recess having a bottom surface spaced from the back face portion and a side wall surface extending between the bottom surface and the strike face;

b) a metal insert located in the strike face, said insert having an exposed front face flush with said strike face and a back face engaging the club head, a central portion of the back face is in contact with the bottom surface of the recess;

c) a plurality of apertures extending into said back face portion;

d) a vibration dampening material located in at least one of said apertures; and e) said insert and vibration dampening material being of different materials.

10. The golf club head of claim 9, wherein the apertures extend to the bottom surface of the recess.

11. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion and a side wall surface extending between the bottom surface and the strike face;

b) an insert located in the recess said insert having a peripheral edge spaced from the side wall surface to form a peripheral groove, and a first vibration dampening material located in the peripheral groove, the insert further including a back face having a first portion in contact with the bottom surface of the recess and a second portion; and c) a plurality of apertures extending from said back face second portion toward the recess and a second vibration dampening material located in at least one of said apertures, and the second portion is in contact with the second vibration dampening material.

* * * * *